United States Patent [19]

Ingle

[11] Patent Number: 5,052,860

[45] **Date of Patent: * Oct. 1, 1991**

[54] SYSTEM FOR MOVING DRILLING MODULE TO FIXED PLATFORM

[75] Inventor: James E. Ingle, Edmond, Okla.

[73] Assignee: Transworld Drilling Company, Oklahoma City, Okla.

[ * ] Notice: The portion of the term of this patent subsequent to Jul: 3, 2007 has been disclaimed.

[21] Appl. No.: 535,792

[22] Filed: Jun. 11, 1990

Related U.S. Application Data

[63] Continuation-in-part of Ser. No. 429,728, Oct. 31, 1989, Pat. No. 4,938,628.

[30] Foreign Application Priority Data

| | | | |
|---|---|---|---|
| Apr. 2, 1990 | [DK] | Denmark | 829/90 |
| Apr. 5, 1990 | [AU] | Australia | 52976/90 |
| Apr. 5, 1990 | [GB] | United Kingdom | 9007728 |
| May 3, 1990 | [NL] | Netherlands | 90.01064 |

[51] Int. Cl.[5] ..... E02B 17/00

[52] U.S. Cl. ..... 405/201; 405/203; 405/196; 14/72.5; 414/138.1; 414/137.7

[58] Field of Search ..... 405/196, 201, 203, 204, 405/208; 14/28, 29, 30, 31, 32, 72.5; 414/139.6, 137.7, 138.7, 137.9, 138.1

[56] References Cited

U.S. PATENT DOCUMENTS

| | | | |
|---|---|---|---|
| 1,894,950 | 1/1933 | Fitch | 414/383 |
| 2,489,862 | 11/1949 | Dunn | 381/158 |
| 2,644,971 | 7/1953 | Rowe | 14/71.7 |
| 2,934,905 | 5/1960 | Woolslayer et al. | 405/209 |
| 2,959,015 | 11/1960 | Beck | 405/209 |
| 2,997,852 | 4/1961 | Suderow | 405/209 |
| 3,011,318 | 12/1961 | Ashton | 405/209 |
| 3,033,525 | 5/1962 | Johnson | 405/201 X |
| 3,150,787 | 9/1964 | Patrignani | 414/273 X |
| 3,448,511 | 6/1969 | Suter | 405/228 X |
| 3,474,629 | 10/1969 | Woodson | 405/201 |
| 3,477,235 | 11/1969 | Branham et al. | 405/203 X |
| 3,931,778 | 1/1976 | Miller | 114/26 |
| 4,065,934 | 1/1978 | Dysarz | 405/196 |
| 4,103,503 | 8/1978 | Smith | 405/203 X |
| 4,602,894 | 7/1986 | Lorenz et al. | 405/203 |
| 4,735,526 | 4/1988 | Kawagoe et al. | 405/196 |
| 4,907,912 | 3/1990 | Smith | 405/208 |
| 4,938,628 | 7/1990 | Ingle | 405/196 X |

FOREIGN PATENT DOCUMENTS

| | | | |
|---|---|---|---|
| 93492 | 2/1960 | Netherlands | 414/137.9 |

*Primary Examiner*—David H. Corbin
*Assistant Examiner*—Arlen L. Olsen
*Attorney, Agent, or Firm*—Herbert M. Hanegan

[57] ABSTRACT

A system for aligning a drilling module on a jack-up rig with a drilling module support surface on a fixed rig wherein the angular disposition of the drilling module is varied by moving a portion of the jack-up rig on at least one of the legs of the jack-up rig to bring the angular disposition of the drilling module into alignment with the angular disposition of the drilling module support surface on the fixed rig prior to transferring the drilling module from the jack-up rig to the fixed rig. The system also includes a position assembly for positioning the drilling module on the drilling module support surface in a predetermined aligned position.

11 Claims, 24 Drawing Sheets

SYSTEM FOR MOVING DRILLING MODULE TO FIXED PLATFORM

CROSS-REFERENCE TO RELATED APPLICATIONS

This is a continuation-in-part of co-pending application Ser. No. 429,728; filed on Oct. 31, 1989; entitled. "SYSTEM FOR MOVING DRILLING MODULE TO FIXED PLATFORM" owned by the assignee of the present invention.

FIELD OF THE INVENTION

The present invention relates generally to methods and apparatus for aligning a drilling module with a drilling module support surface on a fixed platform for transferring the drilling module to the fixed platform and methods and apparatus for positioning the drilling module on the drilling module support surface in an aligned position.

DESCRIPTION OF THE PREFERRED EMBODIMENTS

Figure 1:
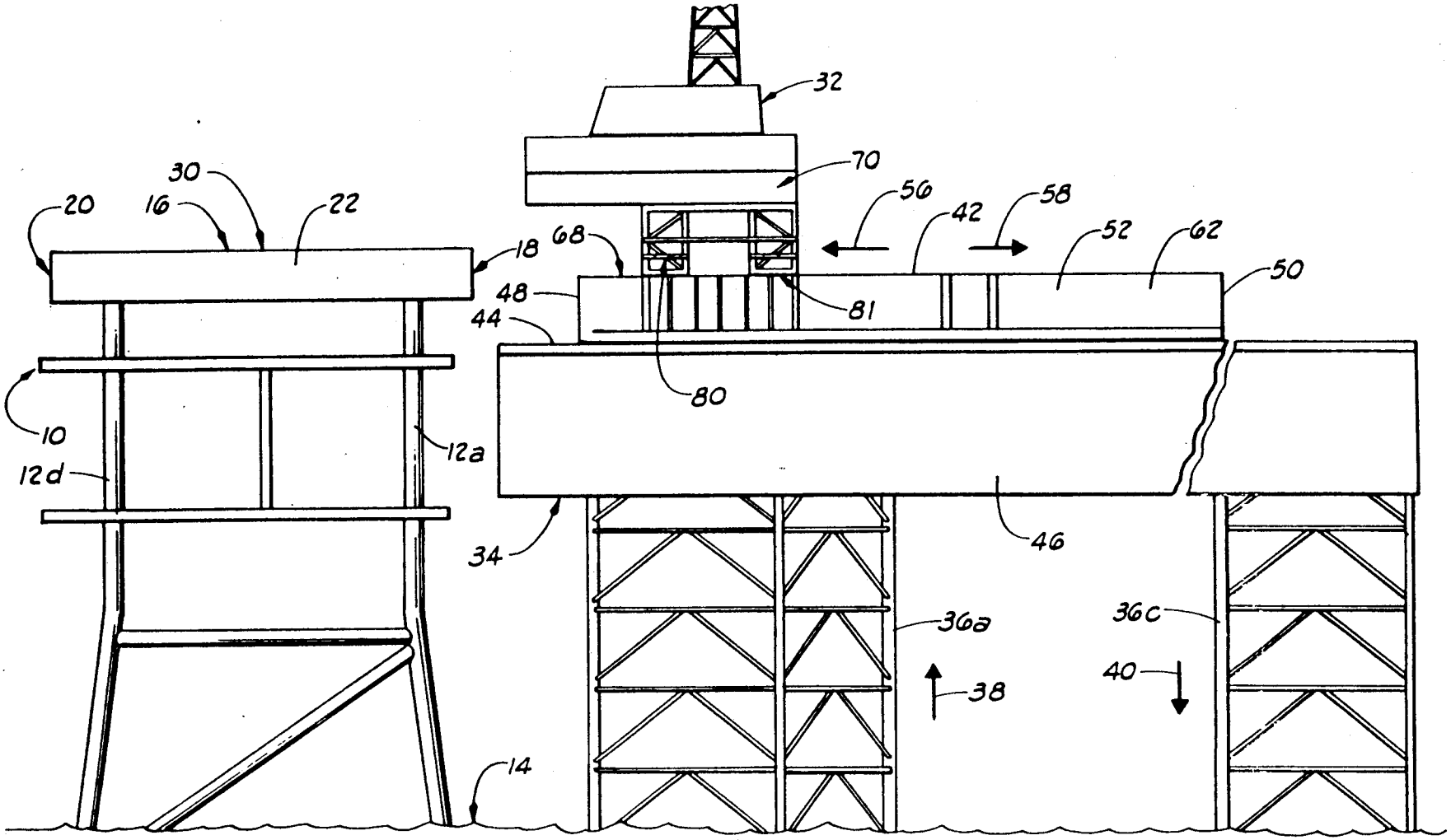
FIG. 1 is a side elevational, diagrammatic view of a fixed platform and a jack-up rig showing a drilling module supported on a cantilever beam assembly on the jack-up rig.
Figure 2:
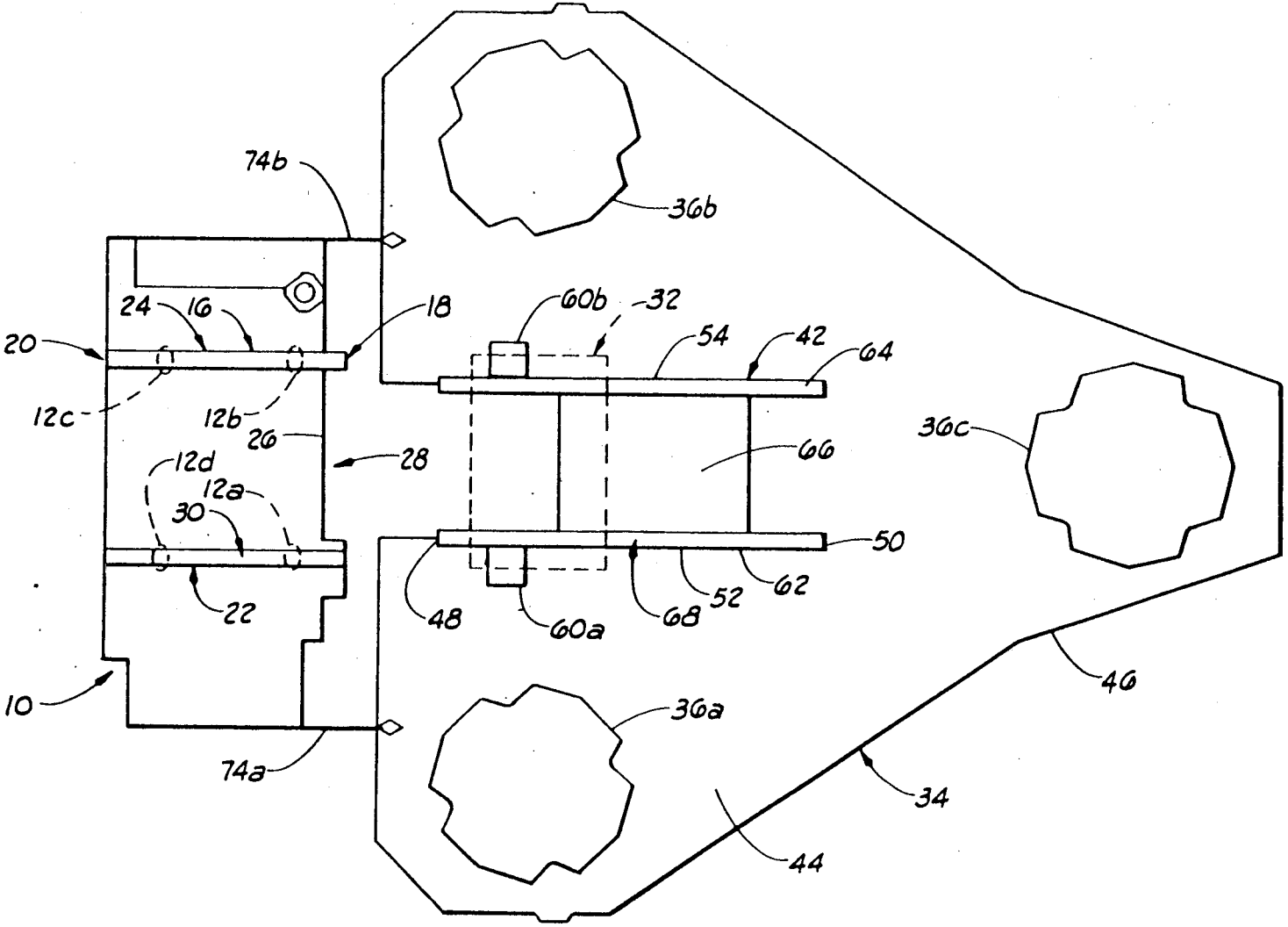
FIG. 2 is a top plan, diagrammatic view of the fixed platform and the jack-up rig shown in FIG. 1, with the drilling module being shown in outline form in dashed lines.
Figure 3:
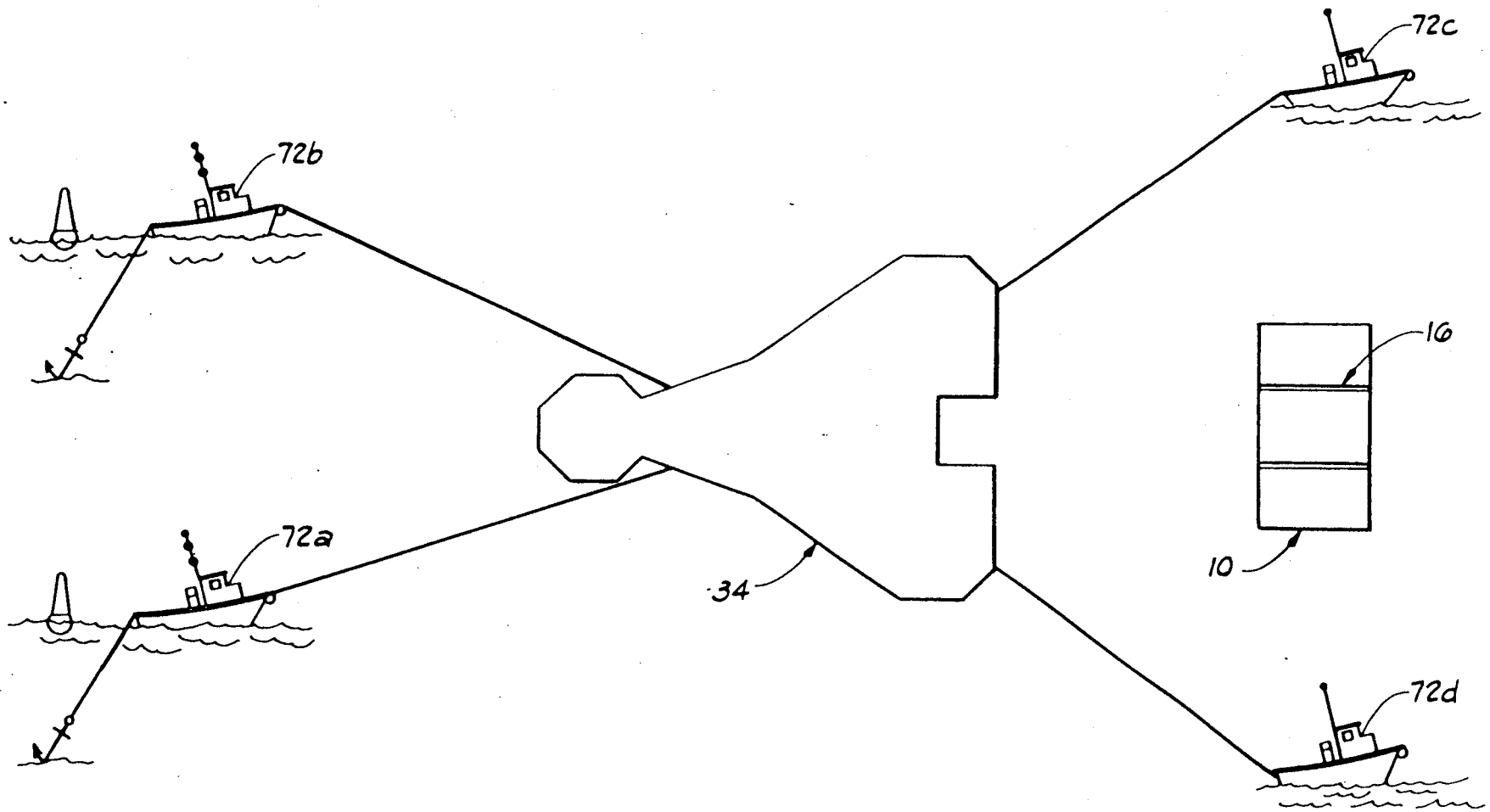
FIG. 3 is a diagrammatic view showing one step in the positioning of the jack-up rig near the fixed platform, the cantilever beam assembly and the drilling module not being shown.

Shown in FIGS. 1 and 2 is a fixed platform 10 having a plurality of legs 12 (four legs being shown in dashed lines in FIG. 2 and designated therein by the reference numerals 12*a*, 12*b*, 12*c* and 12*d*) which extend into and are secured in an ocean floor 14. A fixed platform support structure 16 is connected to the legs 12 of the fixed platform 10. The fixed platform support structure 16 has a front end 18, a rear end 20, a first side 22 and a second side 24. The first side 22 is spaced a distance 26 (FIG. 2) from the second side 24.

A beam opening 28 (FIG. 2) is formed in the fixed platform support structure 16. The beam opening 28 extends through the front end 18 and extends a distance generally toward the rear end 20 of the fixed platform support structure 16.

A drilling module support surface 30 is formed on the fixed platform support structure 16. The drilling module support surface 30 is positioned and adapted to supportingly receive a drilling module 32 (partially shown in FIGS. 1, 7, 8 and 9 and shown in outline form in dashed lines in FIGS. 2 and 6) in a manner to be described in more detail below.

Also shown diagrammatically in FIGS. 1 and 2 is a jack-up rig 34. The jack-up rig 34 has a plurality of telescoping legs 36 (three legs 36 being shown in FIGS. 1 and 2 and designated therein by the reference numerals 36*a*, 36*b* and 36*c*). The legs 36 are movable in an upwardly direction 38 and in a downwardly direction 40, as shown in FIG. 1.

A cantilever beam assembly 42 is movably supported on an upper surface 44 of a hull 46 portion of the jack-up rig 34. The cantilever beam assembly 42 has a rearward end 48, a forward end 50, a first side 52 and a second side 54. The cantilever beam assembly 42 is movably supported on the upper surface 44 for movement in a direction 56 (FIGS. 1, 7, 8 and 9) generally toward extended positions wherein the rearward end 48 is extended distances outwardly from the jack-up rig 34 and in a direction 58 (FIGS. 1, 7, 8 and 9) generally from extended positions (shown in FIGS. 7 and 8) to a storage position (shown in FIGS. 1, 2, 3, 4, 5, 6 and 9) wherein the entire cantilever beam assembly 42 is disposed on the upper surface 44 of the jack-up rig 34.

Figure 6:
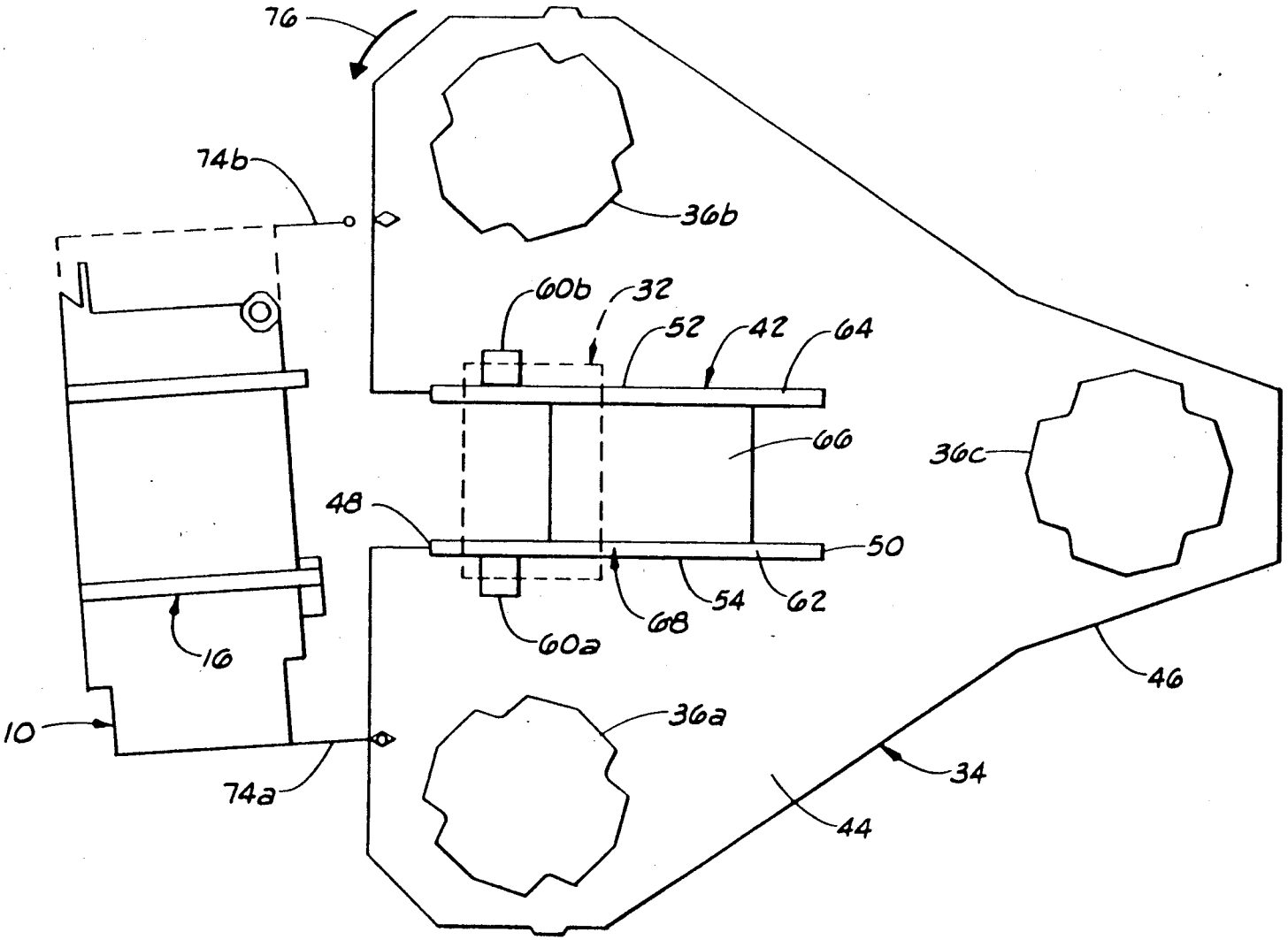
FIG. 6 is a diagrammatic view showing still step in the positioning of the jack-up rig near the fixed platform.

A beam moving assembly 60 is associated with the cantilever beam assembly 42. The beam moving assembly 60 is adapted to move the cantilever beam assembly 42 in the directions 56 and 58. As shown in FIG. 6, the beam moving assembly 60 in one embodiment comprises two portions designated by the reference numerals 60*a* and 60*b*.

Offshore fixed platforms like the fixed platform 10 without the fixed platform support structure 16 are well known in the art and a detailed description of the construction and operation is not deemed necessary. Jack-up rigs like the jack-up rig 34 described above also are well known in the art. Such prior art jack-up rigs commonly include a cantilever beam assembly like the cantilever beam assembly 42 with a beam moving assembly like the beam moving assembly 60. A detailed description of the construction and operation of such a jack-up rig or the cantilever beam assembly or beam moving assembly portions thereof is not deemed necessary herein.

The cantilever beam assembly 42, more particularly, comprises a first cantilever beam 62 (FIGS. 2 and 6) and a second cantilever beam 64 (FIGS. 2 and 6) with a support plate 66 (FIGS. 2 and 6) disposed between the first and the second cantilever beams 62 and 64. One end of the support plate 66 is connected to the first cantilever beam 62 and the opposite end of the support plate 66 is connected to the second cantilever beam 64. The upper surface of the cantilever beam assembly 42 formed by the upper surface of the first and the second cantilever beam 62 and 64 forms a beam support surface 68. The first cantilever beam 60 forms the first side 52. The second cantilever beam 62 forms the second side 54. The rearward ends of the cantilever beams 60 and 62 form the rearward end 48. The forward ends of the cantilever beams 60 and 62 forms the forward end 50. In one form, portion 60*a* of the beam moving assembly 60 comprises a geared track connected to the first cantilever beam 62 and extending a distance outwardly therefrom. The geared track extends a distance generally between the forward end and the rearward end of the first cantilever beam 62.

The drilling module 32 is supported on the beam support surface 68 of the cantilever beam assembly 42. More particularly, a drilling module substructure 70 is connected to the lower end of the drilling module 32 and the drilling module substructure 70 is supported on the beam support surface 68 of the cantilever beam assembly 42.

In many instances, it is necessary to transfer a drilling module to a fixed platform for drilling or reworking an offshore oil or gas well. The present invention particularly is directed to a convenient method for transferring the drilling module 32 to the fixed platform 10 and for removing the drilling module 32 from the fixed platform 10.

Figure 4:
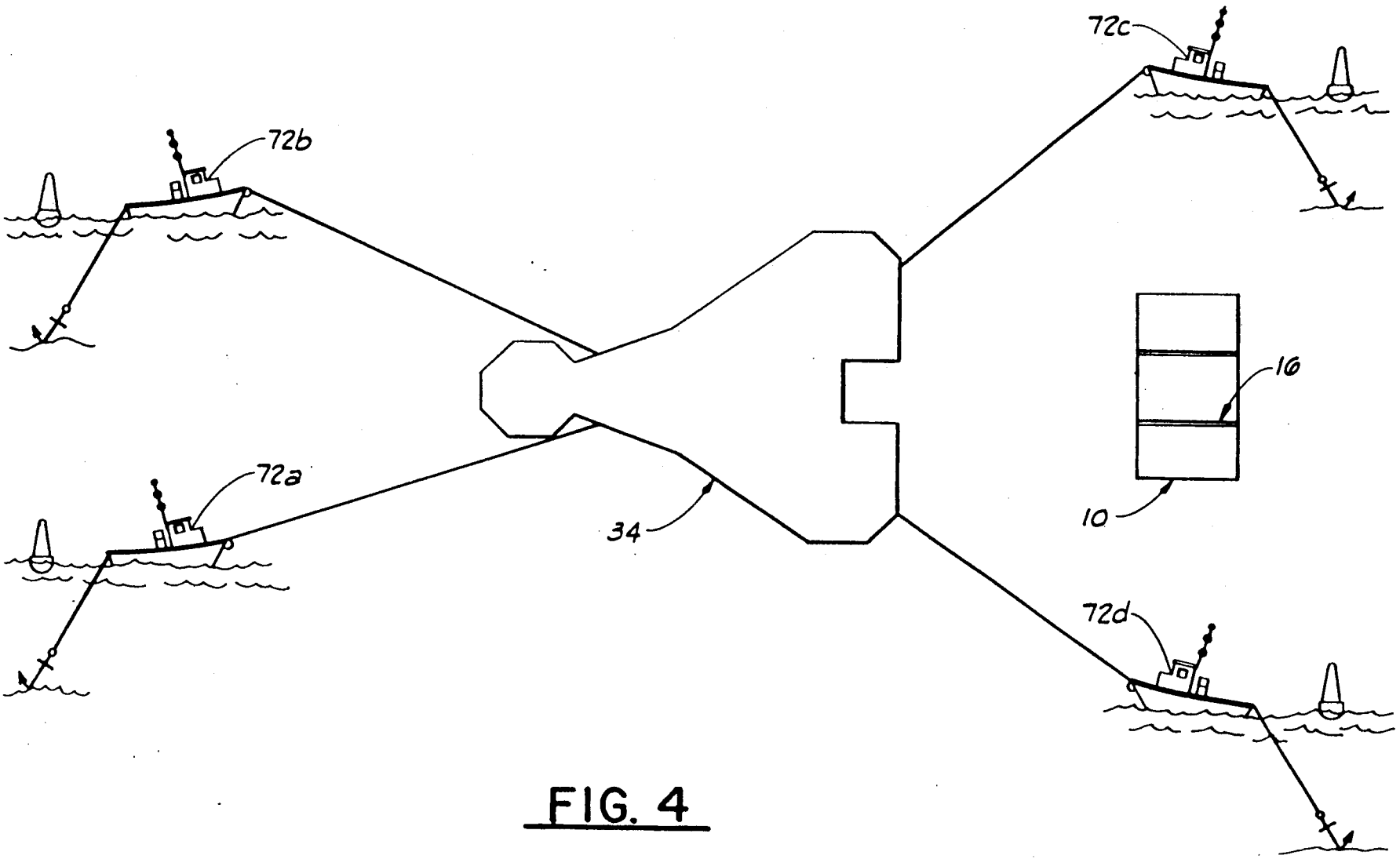
FIG. 4 is a diagrammatic view showing one other step in the positioning of the jack-up rig near the fixed platform, the cantilever beam assembly and the drilling module not being shown.

In operation, the legs 36 of the jack-up rig 34 are moved in the upwardly direction 38 to a storage position so that the hull 46 of the jack-up rig 34 is floatingly supportable on the ocean surface. In this position, the jack-up rig 34 is towed by a plurality of boats 72 (four boats 72 being shown in FIGS. 3-5 and designated therein by the reference numerals 72*a*, 72*b*, 72*c* and 72*d*) to a position wherein the jack-up rig 34 is disposed near the fixed platform 10. In this initial position (shown in FIG. 3), the bow anchors are set by anchoring the boats 72*a* and 72*b*. Then, the port and starboard anchors are set by anchoring the boats 72*c* and 72*d*, as illustrated in FIG. 4. After the bow anchor and the port and starboard anchors have been set, the jack-up rig 34 is moved to a position generally near the fixed platform 10 to a position wherein the cantilever beam assembly 42 is generally aligned with the beam opening 28 in the fixed platform support structure 16 on the fixed platform 10, as illustrated in FIG. 5.

Figure 5:
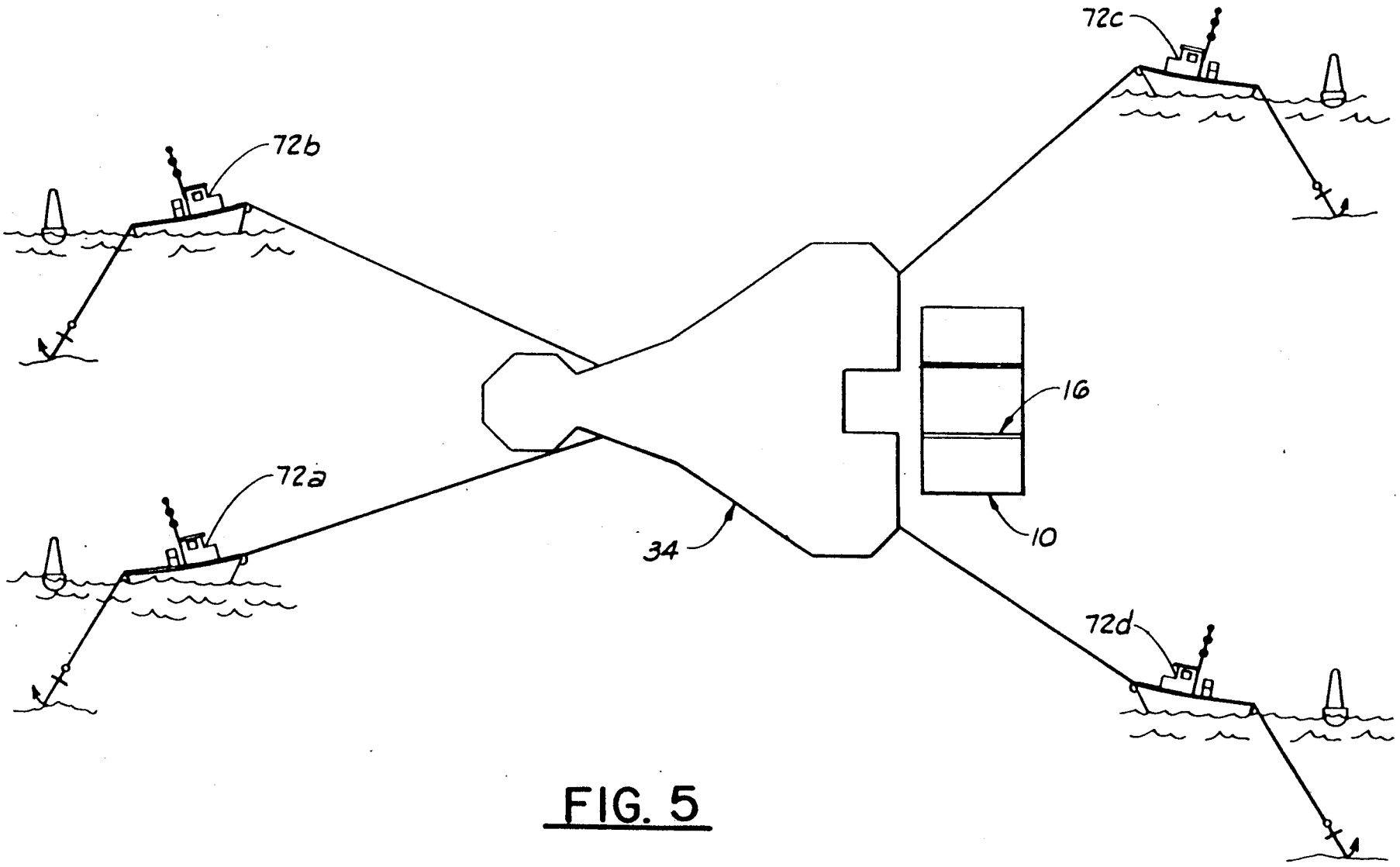
FIG. 5 is another diagrammatic view showing yet another step in the positioning of the jack-up rig near the fixed platform, the cantilever beam assembly and the drilling module not being shown.

When the jack-up rig 34 has been positioned near the fixed platform 10, as shown in FIG. 5, the leg 36*a* is lowered and engaged and set in the ocean floor 14. The jack-up rig 34 then is rotated in a direction 76 (FIG. 6) to a position wherein the cantilever beam assembly 42 is generally aligned with the beam opening 28 in the fixed platform support structure 68, as illustrated in FIG. 2.

As illustrated in FIGS. 2 and 6, lasers suspended from supports 74*a* and 74*b* supported on the fixed platform 10 are alignable with predetermined positions on jack-up rig 34 for assisting in aligning the jack-up rig 34 in a predetermined position with respect to the fixed platform 10. Other forms of alignment assist means may be used in a particular application.

In the this position of the jack-up rig 34 and fixed platform 10, the other two legs 36*b* and 36*c* of the jack-rig 34 are lowered and engaged in the ocean floor 14. In this position, the legs 36 support the hull 46 from the ocean floor 14.

In this position of the jack-up rig 34 and the fixed platform 10, shown in FIGS. 1 and 2, the jack-up rig 34 platform is moved in the upwardly direction 38 or the downwardly direction 40 to a position wherein a lower substructure support surface 80 on the drilling module 32 (more particularly, the drilling module substructure 70) is disposed in a horizontal plane spaced a distance generally above a horizontal plane in which the drilling module support surface 30 is disposed. In this position, the beam moving assembly 60 is actuated or activated to move the cantilever beam assembly 42 with the drilling module 32 supported thereon in a direction 56 generally outwardly and away from the jack-up rig 30 and generally toward the fixed platform 10.

The beam opening 28 in the fixed platform support structure 16 is sized to receive and accommodate a portion of the cantilever beam assembly 42 generally near the rearward end 48 thereof. The cantilever beam assembly 42 is moved in the direction 56 to a position wherein a portion of the cantilever beam assembly 42 generally near the rearward end 48 thereof is disposed within a portion of the beam opening 28 and the lower substructure support surface 80 is disposed generally above the drilling module support surface 30 on the fixed platform support structure 16, as shown in FIG. 7.

Figure 7:
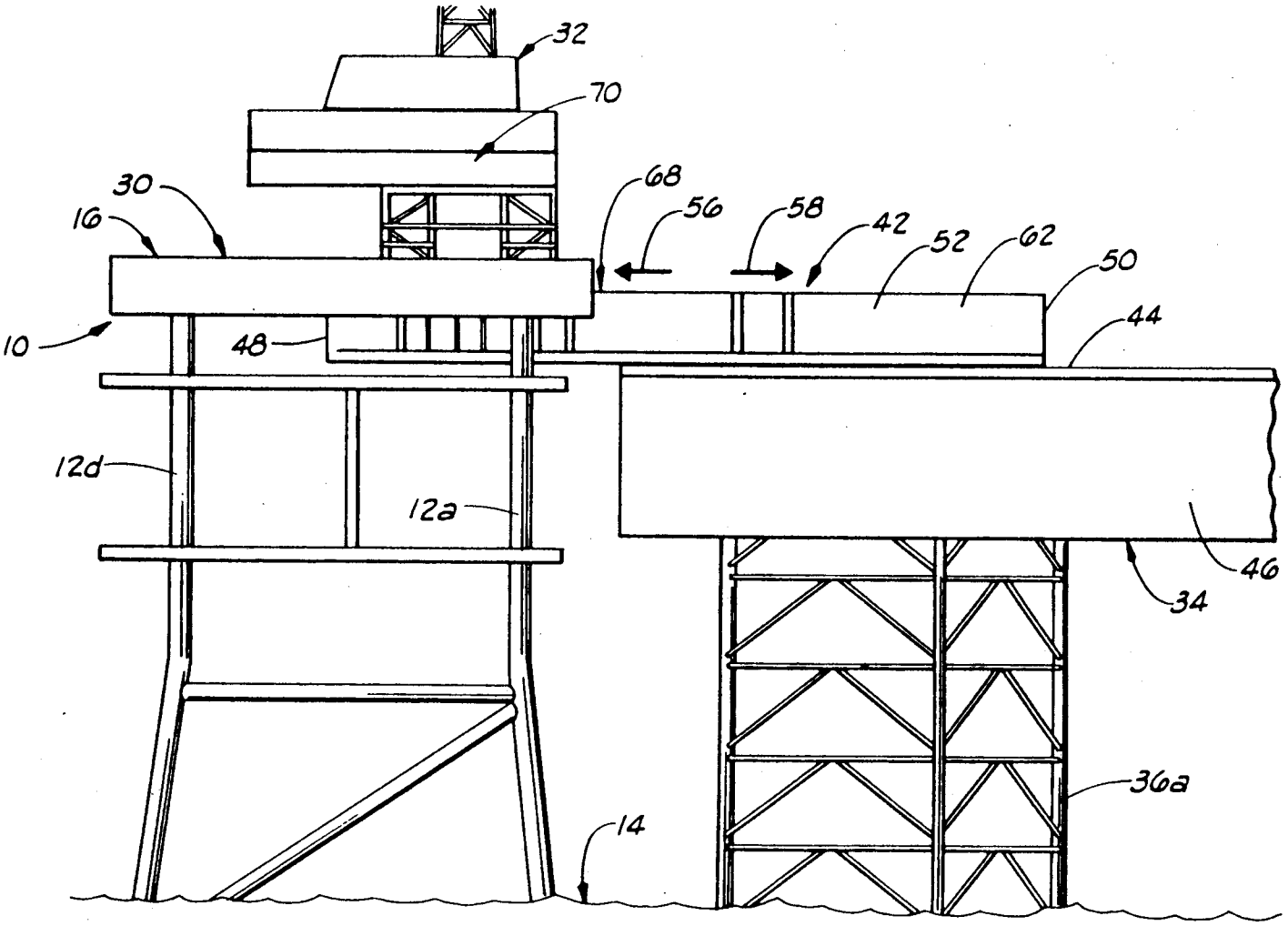
FIG. 7 is a diagrammatic, side elevational view showing the cantilever beam extended from the jack-up rig for positioning the drilling module on the fixed platform.
Figure 8:
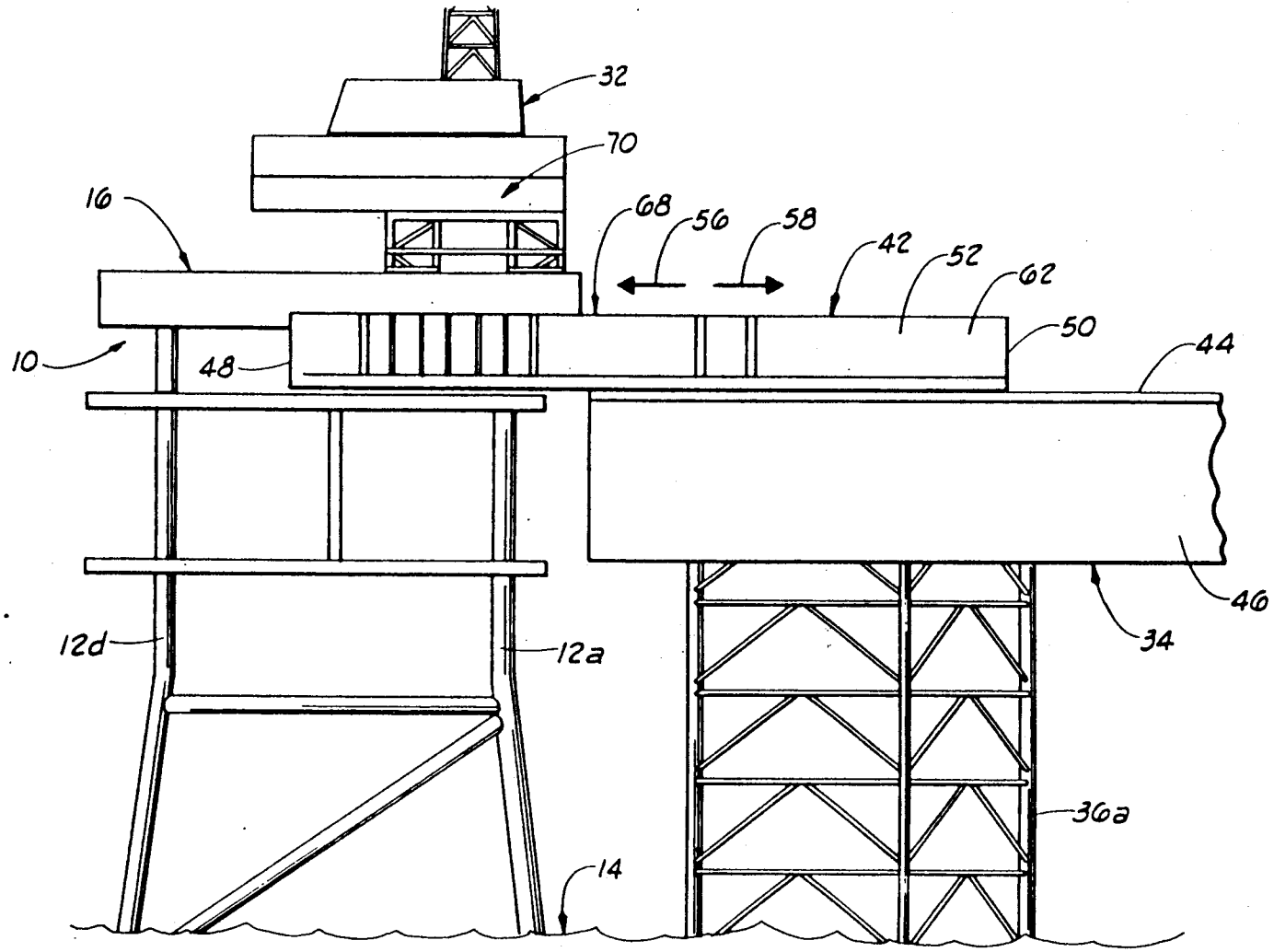
FIG. 8 is a diagrammatic, side elevational view showing the cantilever beam assembly lowered, as compared to the position of the cantilever beam assembly shown in FIG. 7, and showing the drilling module disposed on the fixed platform.

When the cantilever beam assembly 42 with the drilling module 32 supported thereon is positioned as illustrated in FIG. 7, the jack-up rig 34 platform is moved further in the downwardly direction 40 thereby lowering the cantilever beam assembly 42 to a position illustrated in FIG. 8. As the cantilever beam assembly 42 is lowered in the downwardly direction 40, the lower drilling module support surface 80 engages the drilling module support surface 30 on the fixed platform support structure 16 and the drilling module 32 is transferred to the fixed platform support structure 16 with the lower substructure support surface 80 of the drilling module 32 being supported generally on the drilling module support surface 30 of the fixed platform support structure 16.

Figure 9:
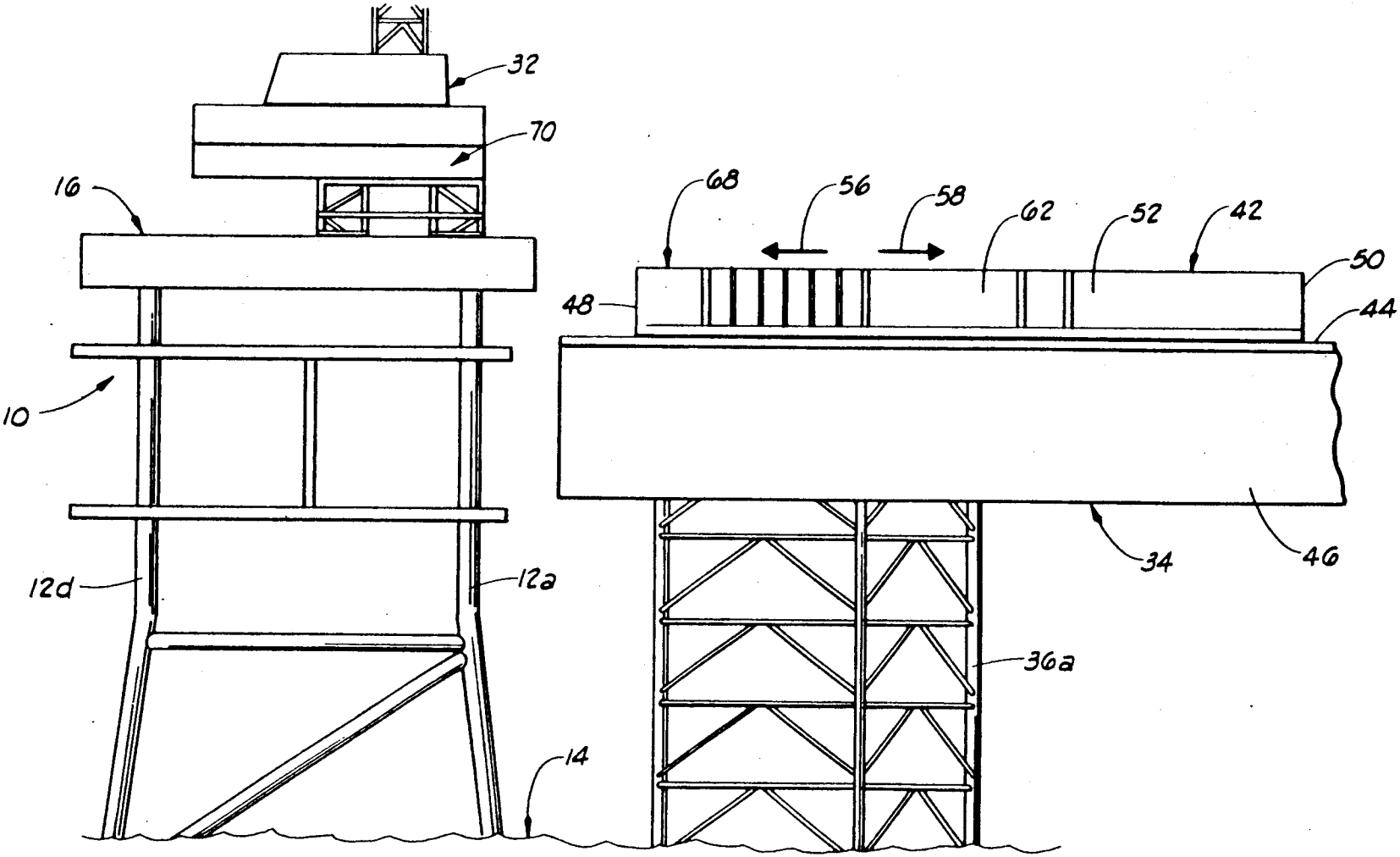
FIG. 9 is a diagrammatic, side elevational view showing the cantilever beam assembly withdrawn from the fixed platform and moved back to the storage position after disposing the drilling module on the fixed platform.

After the drilling module 32 has been transferred to the fixed platform support structure 16, the beam moving assembly 60 is activated to move the cantilever beam assembly 42 in the direction 58 thereby moving the cantilever beam assembly 42 to the storage position. In this position, as illustrated in FIG. 9, the cantilever beam assembly 42 is in the storage position and the drilling module 32 has been transferred to the fixed platform 10 supported on the fixed platform support structure 16.

To remove the drilling module 32 from the fixed platform 10, the process just described is reversed. The jack-up rig 34 is positioned to align the cantilever beam assembly 42 with the beam opening 28. The cantilever beam assembly 42 then is extended into the beam opening 28 generally under the drilling module 32. The jack-up rig 34 platform then is elevated or moved in the upwardly direction 38 so that the beam support surface 68 of the cantilever beam assembly 42 engages a lower beam support surface 81 and the drilling module 32 is lifted from the fixed platform support structure 16. After the drilling module 32 has been positioned on the cantilever beam assembly 42, the beam moving assembly 60 activated to move the cantilever beam assembly 42 in the direction 58 to the storage position on the jack-up rig 34.

Figure 10:
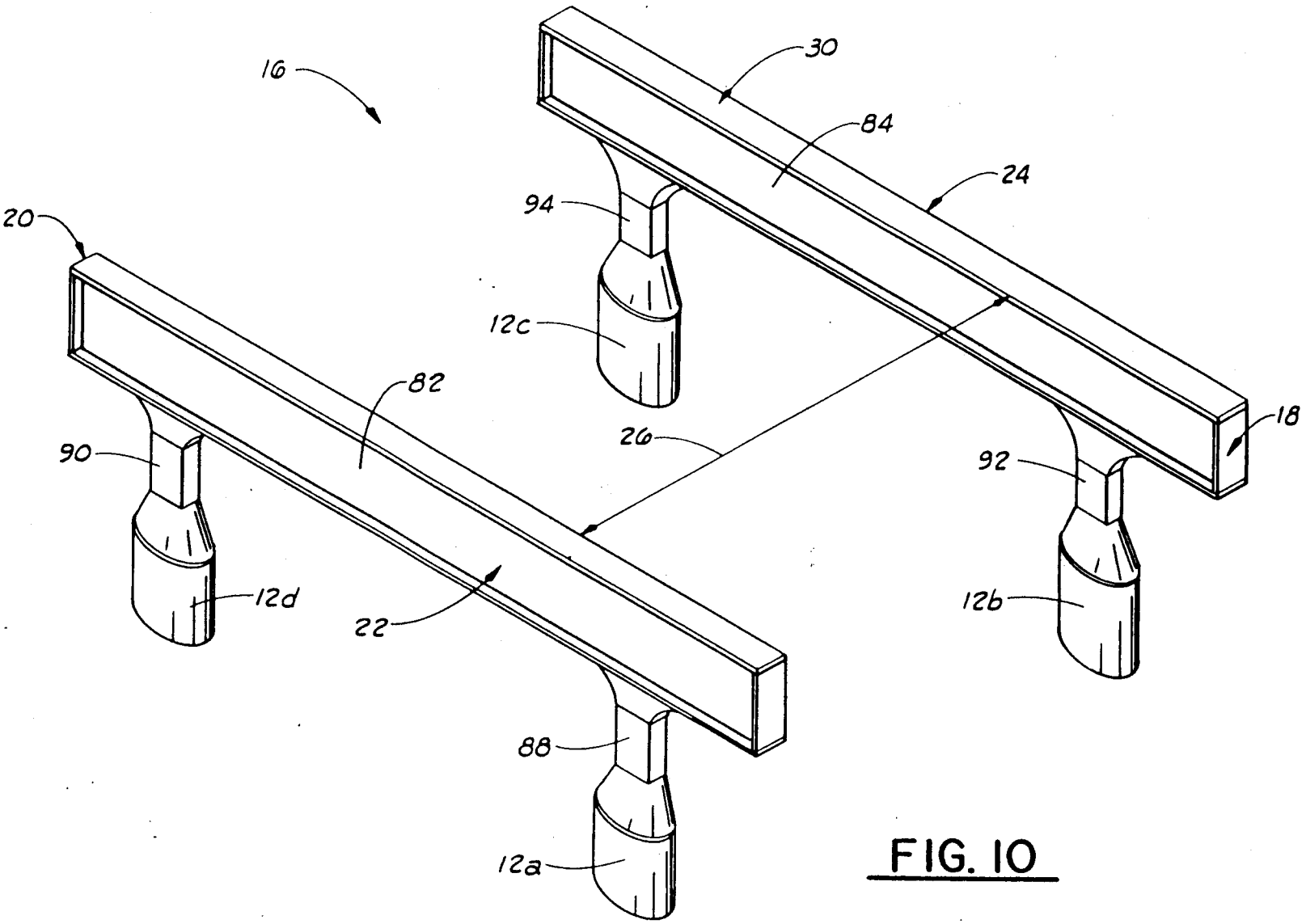
FIG. 10 is a partial perspective view of the fixed platform support structure which is connected to the fixed platform and adapted to support the drilling module.

Shown in FIG. 10 is a perspective view of the fixed platform support structure 16. The fixed platform support structure 16 comprises a first beam 82 and a second beam 84. The first beam 82 forms the first side 22 and the second beam 84 forms the second side 24 of the fixed platform support structure 15. The front ends of the beams 82 and 84 form the front end 18. The rear ends of the beams 82 and 84 form the rear end 20.

The beams 82 and 84 are spaced the distance 26 apart. The upper sides of the beams 82 and 84 cooperate to form the drilling module support surface 30.

It should be noted that the distance 26 could be sized so that one of the cantilever beams 62 extends on the outside of beam 82 and the other cantilever beam 64 extends on the outside of the beam 84 when the cantilever beams 62 and 64 are positioned in the beam opening 28 for disposing the drilling module 32 on the fixed platform support structure 16. In this instance, the drilling module substructure 70 would be modified to cooperate in transferring the drilling module 32 to the fixed platform support structure 16. The beam opening 26 would include one portion on one side of the beam 82 and another portion on one side of the beam 84.

One end of a first leg 88 is connected to the first beam 82, generally near the front end 18. The opposite end of the first leg 88 is connected to the leg 12*a* of the fixed platform 10.

One end of a second leg 90 is connected to the first beam 82, generally near the rear end 20. The opposite end of the second leg 90 is connected to the leg 12*d* of the fixed platform 10.

One end of a third leg 92 is connected to the second beam 84, generally near the front end 18. The opposite end of the third end 92 is connected to the leg 12*b* of the fixed platform 10.

One end of a fourth leg 94 is connected to the second beam 84, generally near the rear end 20. The opposite end of the fourth leg 94 is connected to the leg 12*c* of the fixed platform 10.

The space between the first and the second beams 82 and 84 cooperates to form the beam opening 28. The beam opening 28 also extends from the beams 82 and 84 downwardly and a portion of the fixed platform 10 generally between the legs 12*a* and 12*b* also cooperates to form a portion of the beam opening 28. As mentioned before, the beam opening 28 and the distance 26 are sized so that the cantilever beam assembly 42 with the drilling module 32 positioned thereon can be passed into and a distance through the beam opening 28 in the directions 56 and 58.

Figure 11:
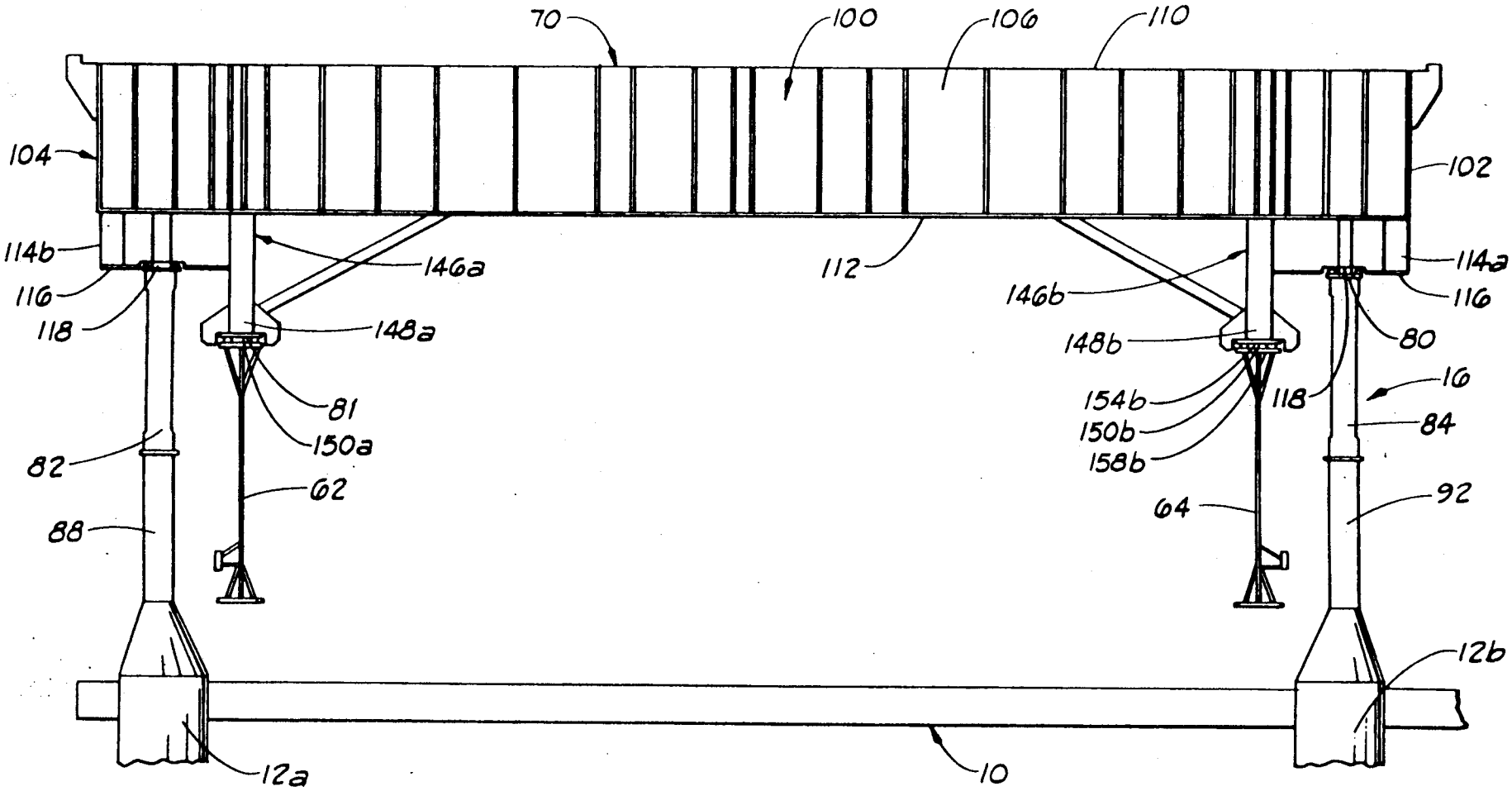
FIG. 11 is an end elevational view showing the drilling module substructure supported on the cantilever beam assembly and positioned in the fixed platform support structure, the drilling module substructure being shown disposed on the fixed platform support structure.
Figure 12:
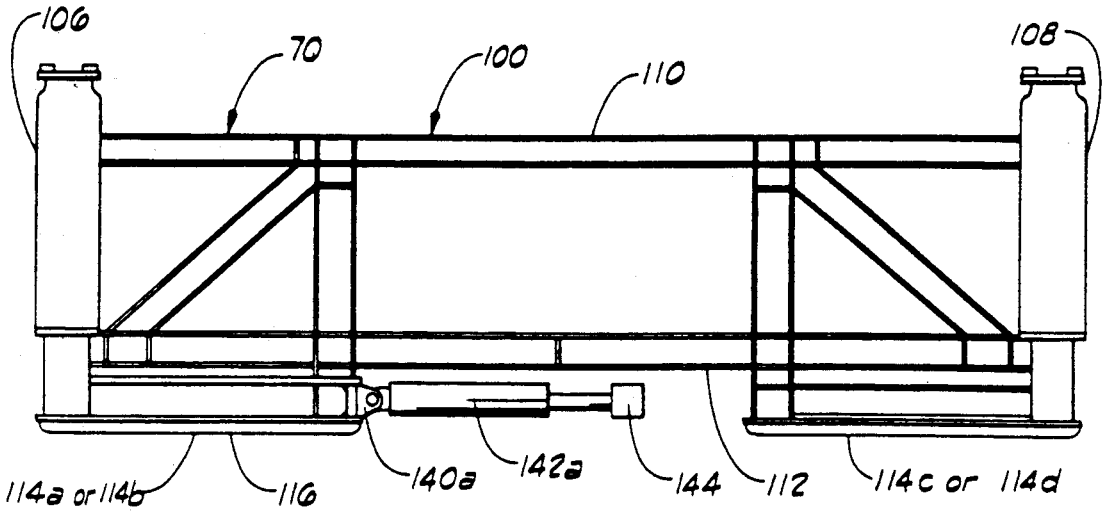
FIG. 12 is a typical side elevational view of the drilling module substructure.
Figure 13:
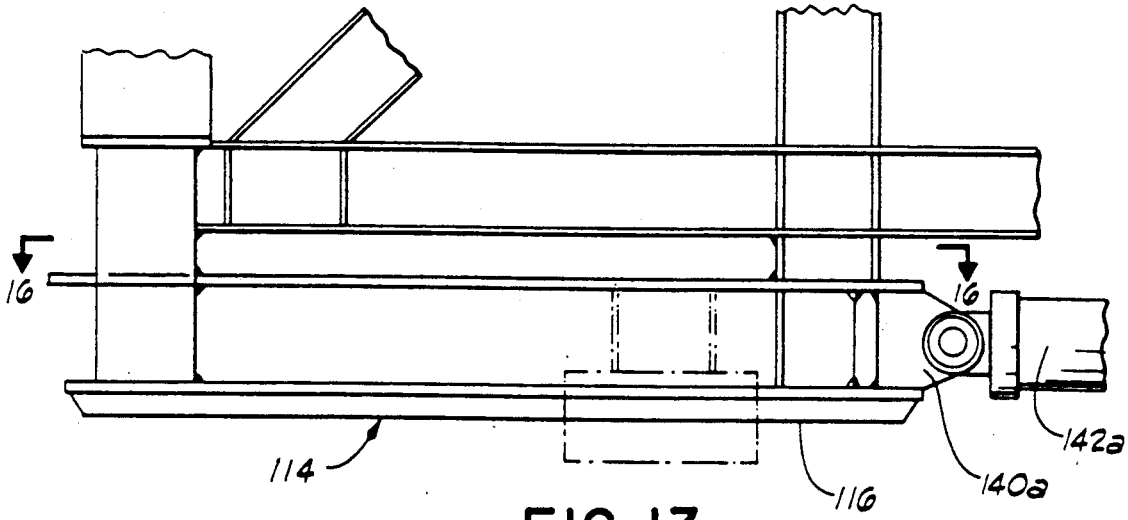
FIG. 13 is a side elevational view of a typical guide shoe portion of the drilling module substructure.
Figure 14:
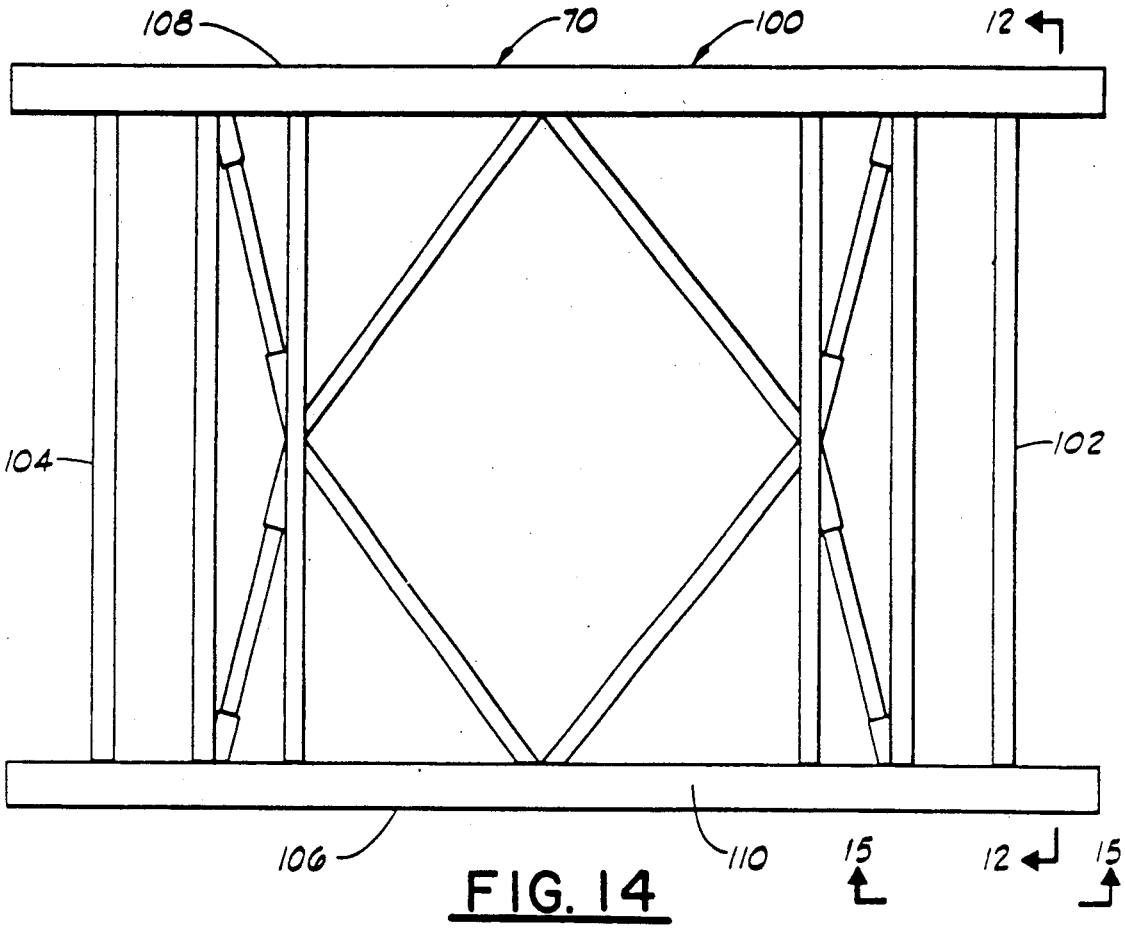
FIG. 14 is a top plan view of the drilling module substructure.
Figure 15:
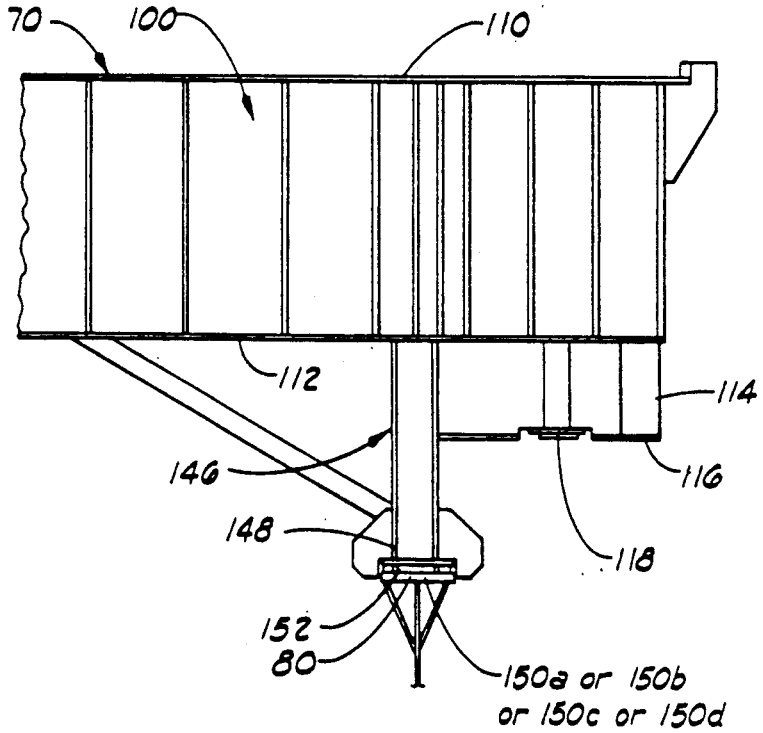
FIG. 15 is a typical end elevational view of a portion of the drilling module substructure showing a typical guide shoe and a typical beam support structure.

The drilling module substructure 70 is shown in detail in FIGS. 11–17. As shown in FIG. 14, the drilling module substructure 70 comprises a base 100 having a first side 102, a second side 104, a front end 106, a rear end 108, an upper surface 110 and a lower surface 112 (FIGS. 11 and 15). The drilling module 32 is supported on the upper surface 110 of the drilling module substructure 70.

As shown in FIGS. 11, 12, 13, 14, 15 and 16, the drilling module substructure 70 includes four guide shoe structures 114. The individual guide shoe structures 114 are designated in the drawings by the reference numerals 114*a*, 114*b*, 114*c* and 114*d*. One of the guide shoe structures 114*a* is located near the first side 102 and near the front end 106, one of the guide shoe structures 114*b* is located near the second side 104 and near the front end 106, one of the guide shoe structures 114*c* is located near the second side 104 and near the rear end 108 and one of the guide shoe structures 114*d* is located near the rear end 108 and near the first side 102. The guide shoe structures 114 are identical in construction and operation.

Each guide shoe structure 114 is connected to the lower end 112 of the drilling module substructure 70. Each guide shoe structure 114 extends a distance from the lower end 112 of the drilling module substructure 70 terminating with an outer end 116 (FIGS. 11, 12, 13 and 15). A guide shoe 118 (FIGS. 11 and 15) is connected to the outer end 116 of each guide shoe structure 114.

The ends of the guide shoes 118 cooperate to form the lower substructure support surface 80. The lower substructure support surface 80 is disposable on the drilling module support surface 30 of the fixed platform support structure 16. More particularly, when the drilling module 32 is disposed on the fixed platform support structure 16, the guide shoes 118 engage the drilling module support surface 30, with two of the guide shoes 118 being disposed on the upper end of the first beam 82 and with two of the guide shoes 118 being disposed on the upper end of the second beam 84.

The outer ends 116 of the guide shoe structures 114 are extended and provide a support surface. If the drilling module 32 initially is misaligned with the beams 82 and 84, the drilling module 32 is supported on the beams 82 and 84 via the outer ends 116 while the drilling module 32 is moved into the aligned position.

Figure 18:
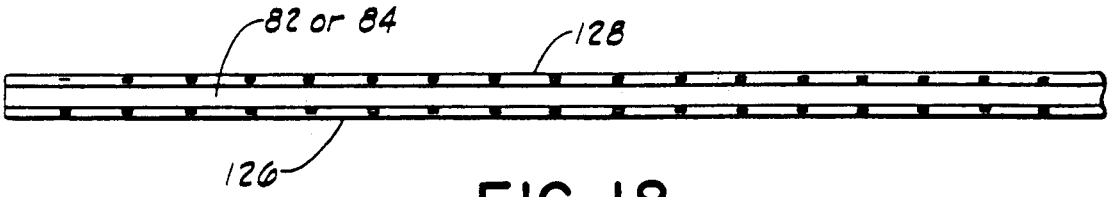
FIG. 18 is a top plan view of a typical beam of the fixed platform support structure showing two restraining bars secured to an upper surface thereof for restraining lateral movement of the drilling module when the drilling module is disposed on the fixed platform support structure.
Figure 19:
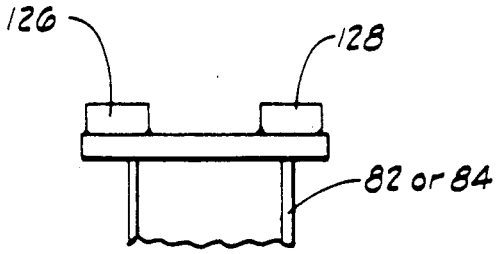
FIG. 19 is an end elevational view of the beam shown in FIG. 18.
Figure 20:
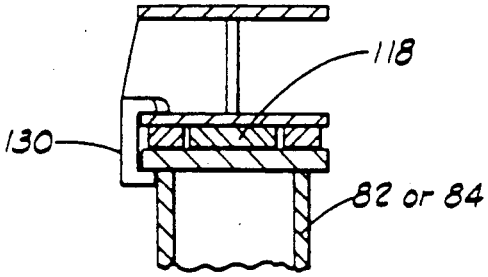
FIG. 20 is a sectional view showing a typical clamp means for restraining tilting movement and movement in forward and rearward directions of the drilling module on the fixed platform support structure.

After the drilling module substructure 70 is disposed on the fixed platform support structure 16, a pair of restraining bars 126 and 128 are connected to the upper ends of the first and the second beams 82 and 84. More particularly, each of the first and the second beams 82 and 84 includes a first restraining bar 126 (FIGS. 18 and 19) which is secured to the upper ends of the respective first and second beams 82 and 84. Each of the beams 82 and 84 also includes a second restraining bar 128 (FIGS. 18 and 19). The restraining bars 128 are secured to the respective upper ends of the first and second beams 82 and 84. The restraining bars 126 and 128 are disposed on opposite sides of the guide shoes 118 (FIG. 20). The restraining bars 126 and 128 cooperate with the guide shoes 118 to restrain lateral movement of the drilling module substructure 70 and the drilling module 32 connected hereto in directions generally toward the first side 22 and generally toward the second side 24 of the fixed platform support structure 16.

A plurality of clamps 130 (a typical clamp being shown in FIG. 20) are connected to the beams 82 and 84 and to the drilling module substructure 70 after the drilling module 32 has been disposed on the fixed platform support structure 30. The clamps 130 cooperate to restrain tilting movement of the drilling module 32 and to restrain movement of the drilling module 32 in forward and rearward directions.

Figure 16:
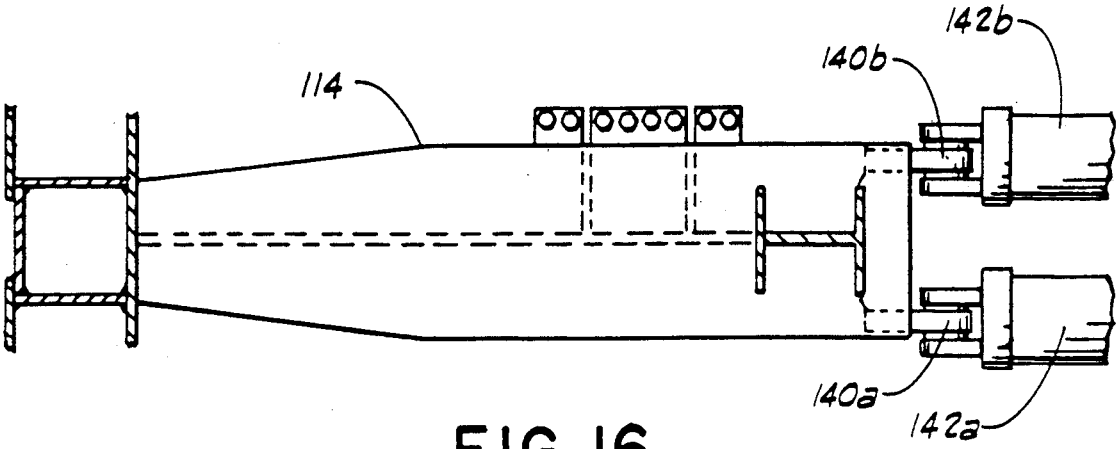
FIG. 16 is a view of a portion of the drilling module substructure, taken substantially along the lines 16—16 of FIG. 13.

(As shown in FIGS. 12, 13 and 16) a pair of ears 140*a* and 140*b* are connected to each of the guide shoes 114*a* and 114*b*. A pair of hydraulic cylinders 142*a* and 142*b* are connected to the respective ears 140*a* and 140*b* via spherical bearings. Each of the hydraulic cylinders 140*a* and 140*b* are connected to a pad 144 (FIG. 12).

The pads 144 connected to the hydraulic cylinders 142*a* and 142*b* associated with the guide shoe 114*a* is connectable to the upper end of the first beam 82. The pad 144 connected to the hydraulic cylinders 142*a* and 142*b* associated with the guide shoe 114*b* is connectable to the upper end of the second beam 84. By actuating the hydraulic cylinders 142*a* and 142*b*, the drilling module substructure 70 and the drilling module 32 connected thereto is moveable in directions generally toward the front end 106 and generally toward the rear end 108 of the fixed platform support structure 16.

In lieu of connecting the hydraulic cylinders 142*a* and 142*b* to the fixed platform support structure 16, such hydraulic cylinders 142*a* and 142*b* can be connected to other portions of the fixed platform 10 for moving the fixed platform support structure 16 in different directions. If the drilling module 32 initially is positioned on the fixed platform support structure 16 at an angle, the hydraulic cylinders 142*a* and 142*b* can be used to move the drilling module substructure 70 with the drilling module 32 connected thereto to an aligned position on the fixed platform support structure 16.

Figure 17:
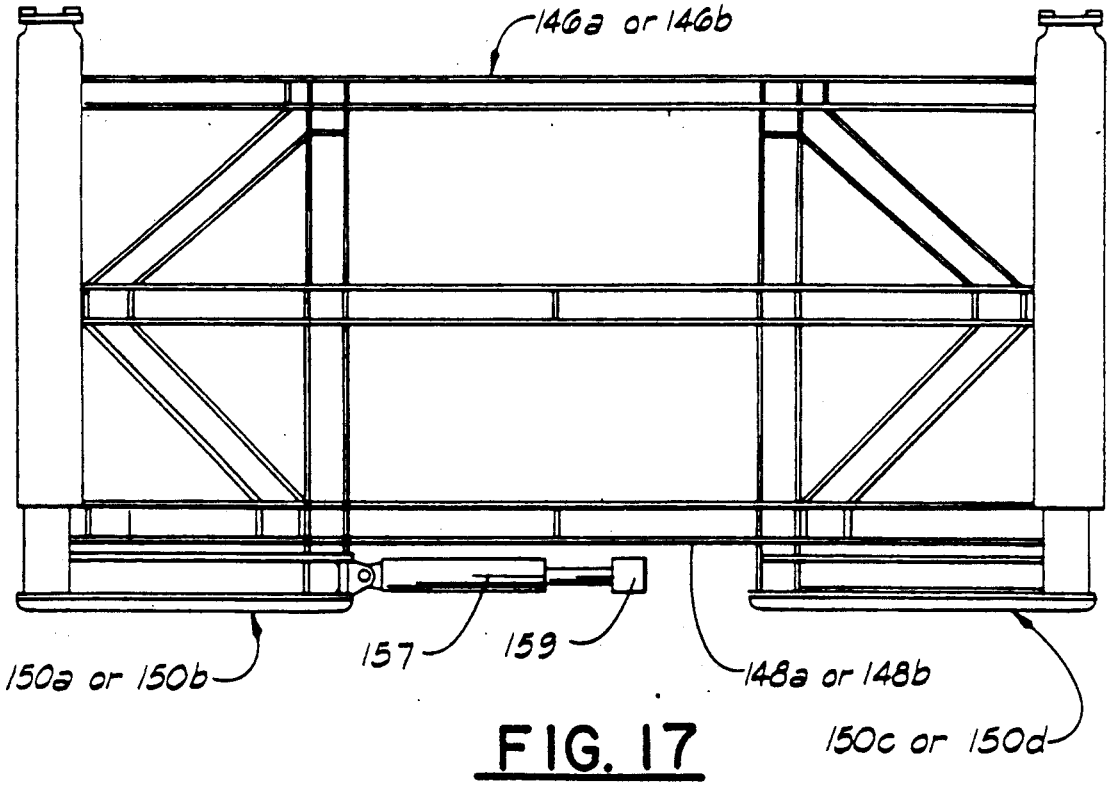
FIG. 17 is a side elevational view of a typical beam support frame of the drilling module substructure.

As shown in FIGS. 11, 15 and 17, the drilling module substructure 70 includes a pair of beam support frames 146*a* and 146*b*. The beam support frames 146*a* and 146*b* are identical in construction. One end of each beam support frame 146*a* and 146*b* is secured to lower surface 112 of the base 100 and each beam support frame 146*a* and 146*b* extends a distance from the lower surface 112 of the base 100 terminating with a lower end 148*a* and 148*b*, respectively.

Each beam support frame 146 includes a pair of guide shoes 150. Each of the guide shoes 150 is connected to the lower end 148 of the beam support frame 146. The four individual guide shoes 150 are designated in FIGS. 11 and 15 by the respective reference numerals 150*a*, 150*b*, 150*c* and 150*d*. The guide shoes 150*a* and 150*b* are disposed generally near the front end 106 of the drilling module substructure 70 and the guide shoes 150*c* and 150*d* are disposed generally near the rear end 108 of the drilling module substructure 70. The guide shoes 150*a* and 150*d* are connected to the beam support frame 146*a* and the guide shoes 150*b* and 150*c* are connected to the beam support frame 146*b*. The guide shoes 150 are identical in construction and operation.

Two of the guide shoes 150 are connected to each of the beam support frames 146 and each of the guide shoes 150 extends a distance from the lower end 148 of one of the beam support frames 146 terminating with an outer end 152 (FIG. 15). The ends 152 of the guide shoes 150 cooperate to form a lower beam support surface 81.

In operation, the substructure 70 is positioned on the cantilever beams 60 and 62 in a position wherein the substructure 170 and the drilling module 32 are supported on the cantilever beams 62 and 64 via the guide shoes 150 and the beam support surface 68 engages the lower beam support surface 81. The lower beam support surface 81 is disposed in a horizontal plane generally below the horizontal plane in which the lower substructure support surface 80 is disposed.

Figure 21:
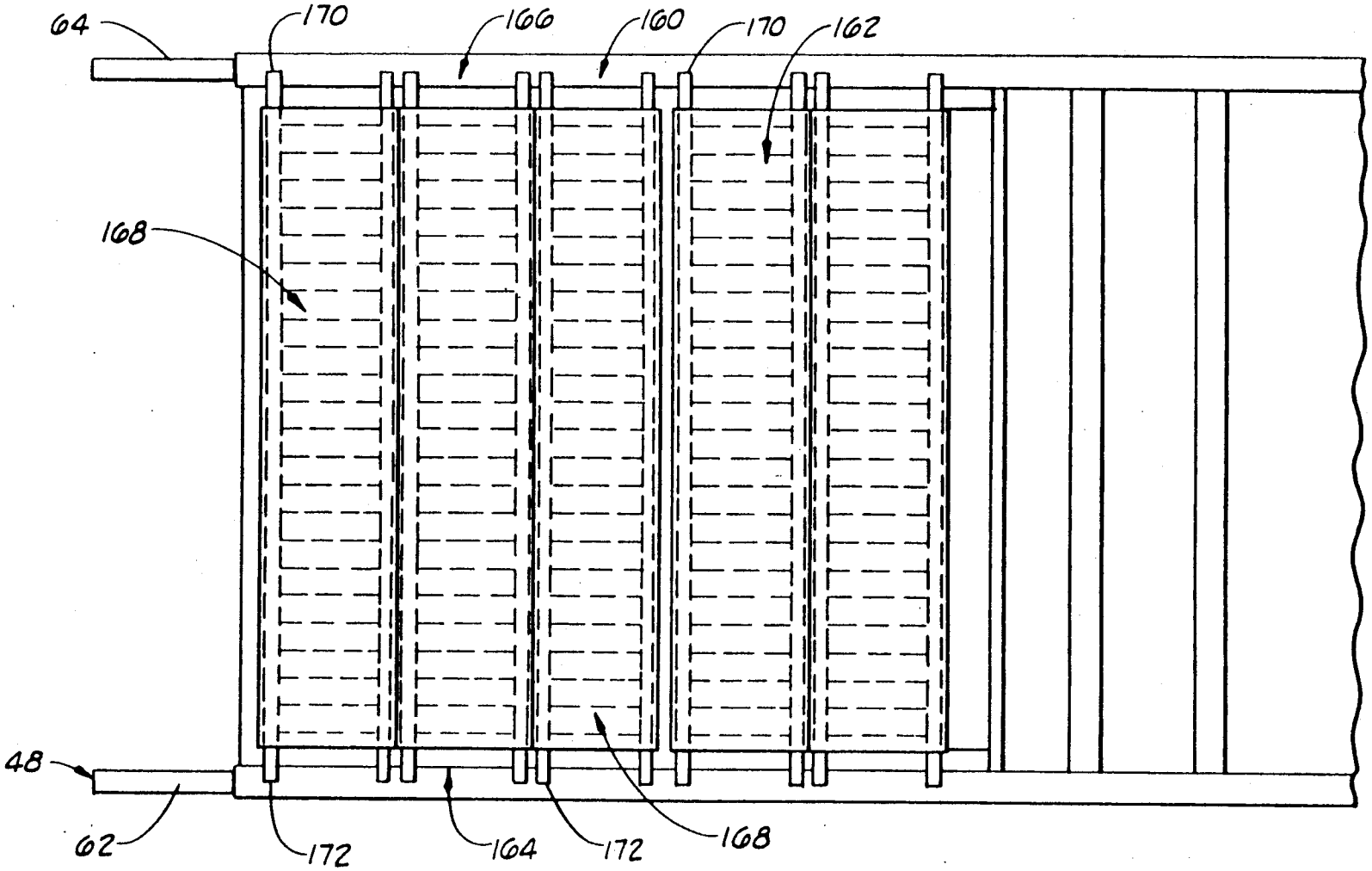
FIG. 21 is a top plan view of a floor assembly showing a floor which is supported generally under the drilling module when the drilling module has been removed from the cantilever beam assembly.
Figure 22:
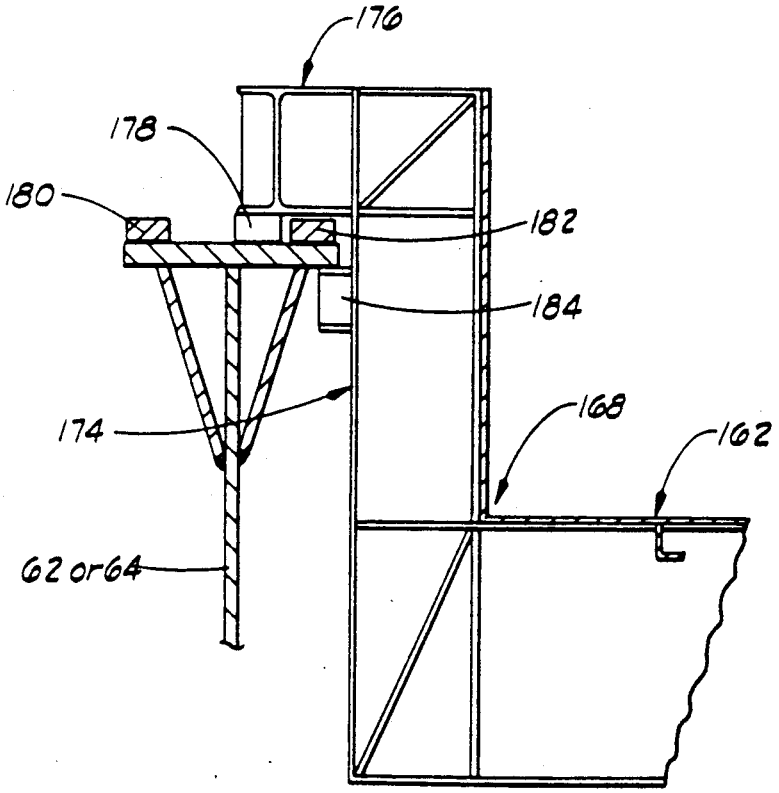
FIG. 22 is a sectional view showing a typical floor support for removably supporting the floor of the floor assembly shown in FIG. 21 on the cantilever beam assembly and generally under the drilling module.

In one embodiment, the present invention also contemplates a removable floor assembly 160, as shown in FIGS. 21 and 22 which is supported on the cantilever beams 62 and 64 and disposed generally under the drilling module substructure 70. The removable floor assembly comprises a floor 162 which extends between the cantilever beams 62 and 64 and extends a distance generally from the rearward end 48 of the cantilever beam assembly 42 generally toward the forward end 50 thereof. The floor 162 has opposite sides 164 and 166.

The floor assembly 160 comprises a plurality of floor members 168. Each of the floor members 168 is identical in construction and operation and only two of the floor members 168 are designated by reference numerals in FIG. 21. Each floor member !68 has opposite ends 170 and 172.

A pair of floor supports 174 (FIG. 22) are connected the end 170 and another pair of floor supports 174 are connected to the end 172 of each of the floor members 168. The floor supports 174 are identical in construction and operation and a typical floor support 174 is shown in FIG. 22.

Each floor support 174 extends a distance from the end 170 or 172 of one of the floor members 168 in a generally upwardly direction. An overhang 176 is formed on one end of each of the floor support 174. The overhang 176 extends a distance generally over the upper end of one of the cantilever beams 62 or 64. A stop 178 is connected to the overhang 176 and the stop 178 is generally disposed on the upper end of the cantilever beams 62 or 64.

A pair of restraining bars 180 and 182 are secured to the upper end of each of the cantilever beams 62 and 64. The stop 178 is engagable with the restraining bar 182 for cooperating to secure the floor assembly 160 in a position connected to the cantilever beam 62 or 64. A second stop 184 is removably secured to the floor support 174. The second stop 184 is positioned to engage a portion of the cantilever beam 62 or 64. The stops 178 and 184 cooperate to secure the removable floor assembly 160 connected to the cantilever beams 62 and 64. When it is desired to remove the floor assembly 160 from the cantilever beam assembly 42, it is necessary to remove the second stops 184.

It should be noted that the restraining bars 180 and 182 on the cantilever beams 62 and 64 cooperate to engage the bars 156 of the guide shoes 150 to restrain lateral movement of the drilling module substructure 70 when the drilling module substructure 70 with the drilling module 32 supported thereon is disposed on the cantilever beams 62 and 64.

Figure 23:
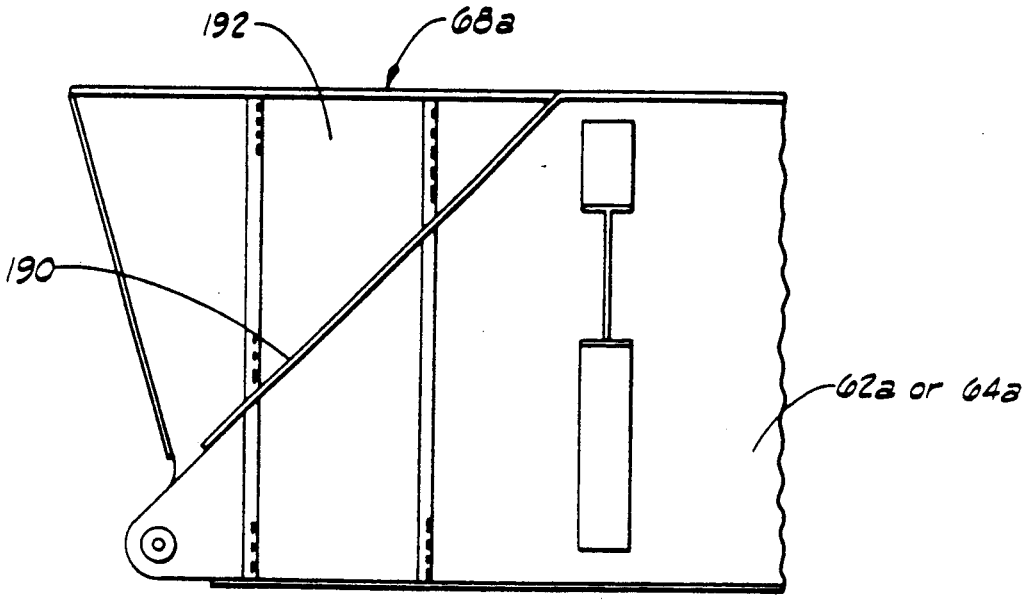
FIG. 23 is a side elevational view of a forward end portion of a typical cantilever beam showing a beam extension connected thereto.

Some existing cantilever beams include a tapered forward end. In some applications, it may be desired to extend the effective surface of the cantilever beams to provide an additional length. Shown in FIG. 23 is a cantilever beam **62*a* or 64*a* having a tapered forward end 190. A beam extension 192 is secured to the cantilever beam 62*a* or 64*a* to extend the beam support surface 68*a***.

Figure 24:
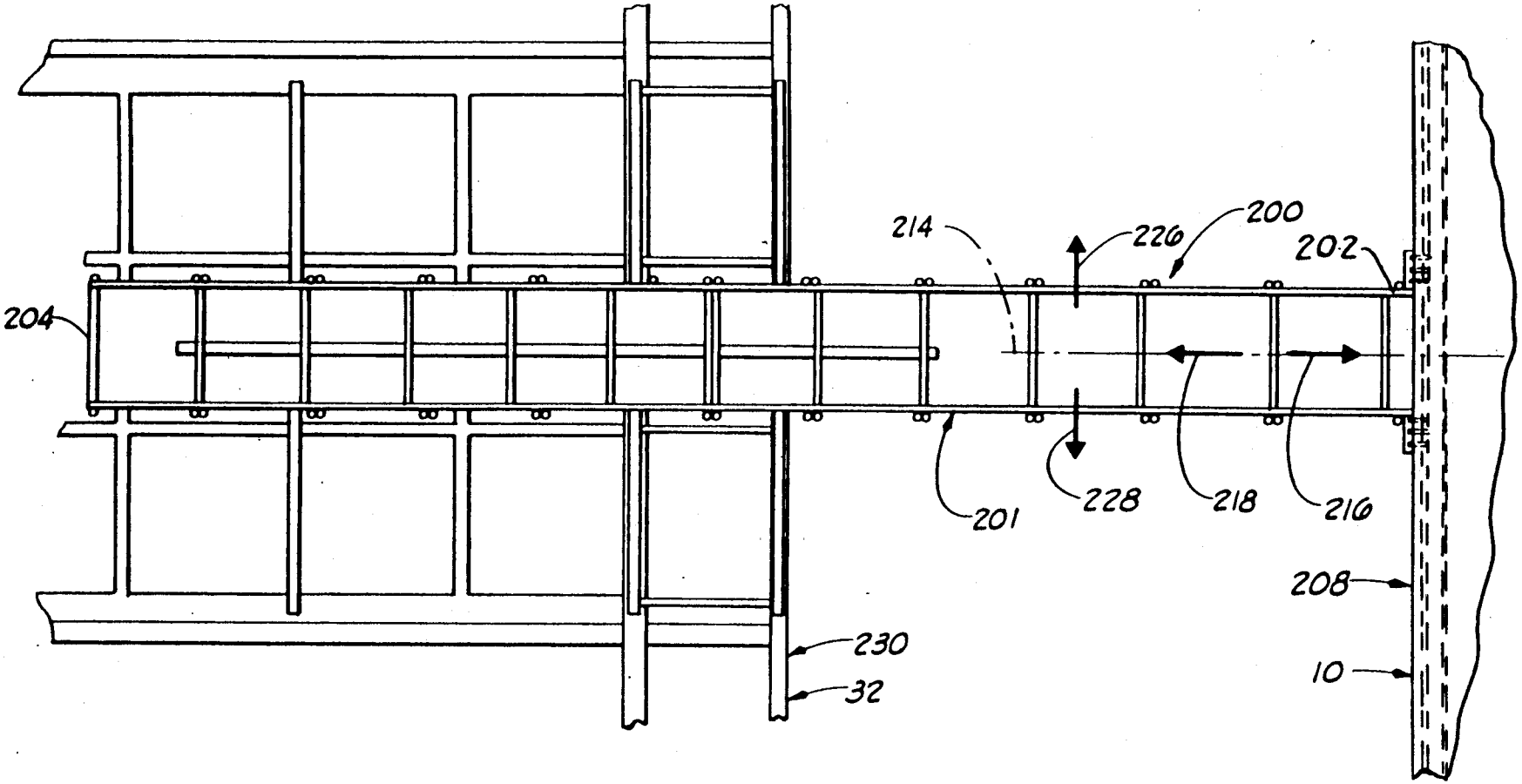
FIG. 24 is a top plan view showing a dragway bridge assembly movably connected to the fixed platform (partially shown in FIG. 24) and movably connected to the jack-up rig (partially shown in FIG. 2–4).
Figure 25:
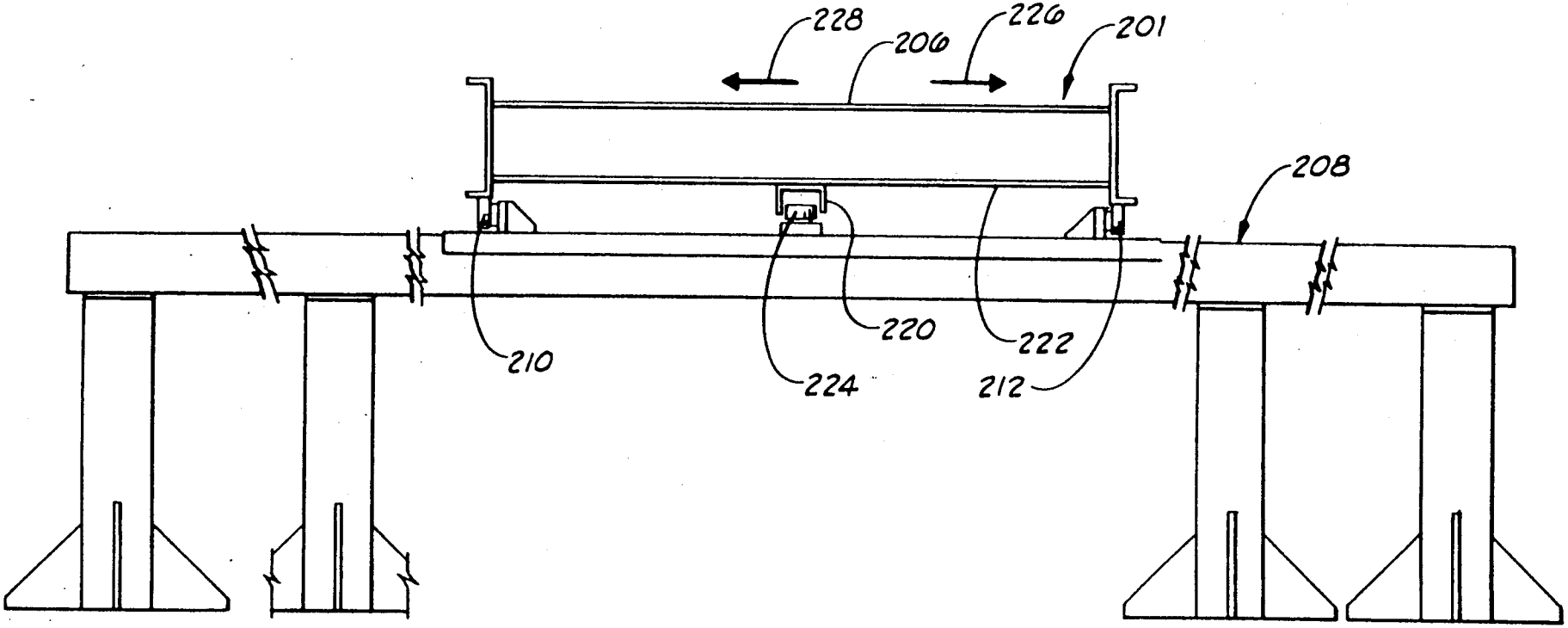
FIG. 25 is an end elevational view showing a portion of the bridge of the dragway bridge assembly movably connected to the fixed platform.
Figure 27:
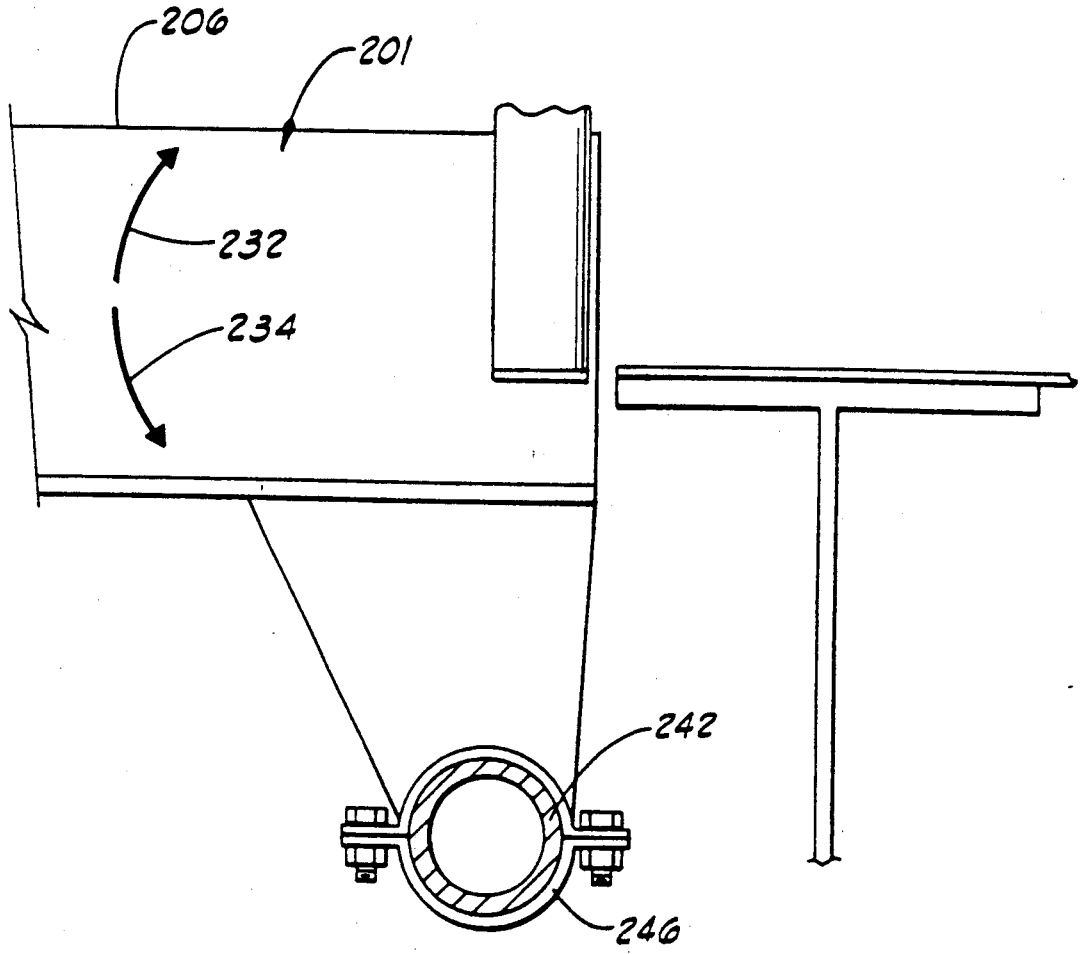
FIG. 27 is a side elevational view, partial sectional view showing another portion of the connection of the bridge to the jack-up rig.

Shown in FIGS. 24, 25 and 27 is a dragway bridge assembly 200 having a first end 202, a second end 204 and an upper surface 206 forming a bridge surface. After the drilling module 32 has been disposed on the fixed platform 210 and the cantilever beam assembly 42 has been moved to the storage position, it is convenient to have a bridge extending between the fixed platform 10 and the jack-up rig 34 so that pipe may be pulled from the jack-up rig 34 across the bridge and moved onto the fixed platform 10 for example. The dragway bridge assembly 200 is provided for such purposes.

Shown in FIG. 25 is a structure portion 208 of the fixed platform 10. A pair of rollers 210 and 212 are rollingly supported on the structure portion 208. The roller 210 rollingly engages one side of the bridge 201 and the roller 212 rollingly engages the opposite side of the bridge 201. The bridge 201 thus is rollingly supported on the fixed platform 10 for movement along a bridge axis 214 (FIG. 24) extending generally between the first and second ends 202 and 204 of the bridge 201. The bridge 201 more particularly movably supported on the fixed platform 10 for movement in a first direction 216 (FIG. 24) and in an opposite second direction 218 (FIG. 24).

As shown in FIG. 25, a channel 220 is connected to a lower surface 222 of the bridge 201. A third roller 224 is rollingly supported on the structure portion 208. The third roller 224 is disposed generally in the channel 220 and positioned to rollingly engage the opposite sides of the channel 224. The third roller 224 cooperates with the channel 220 to limit movement of the bridge 201 generally at the connection of the bridge 201 to the fixed platform 10 in directions generally perpendicular to the bridge axis 214 or, more particularly, to limit movement of the bridge 201 in a first direction 226 and in an opposite second direction 228 (shown in FIGS. 24 and 25).

The bridge 201 is connected to a structure portion 230 (FIG. 24) of the jack-up rig 34 in such a manner that the bridge 201 is moveable generally at the connection between the bridge 201 and the jack-up rig 34 in the lateral directions 226 and 228 generally perpendicular to the bridge axis 214 and such that the bridge 201 is pivotally moveable in a generally upwardly direction 232 (FIG. 27) and in a generally downwardly direction 234 (FIG. 27).

Figure 26:
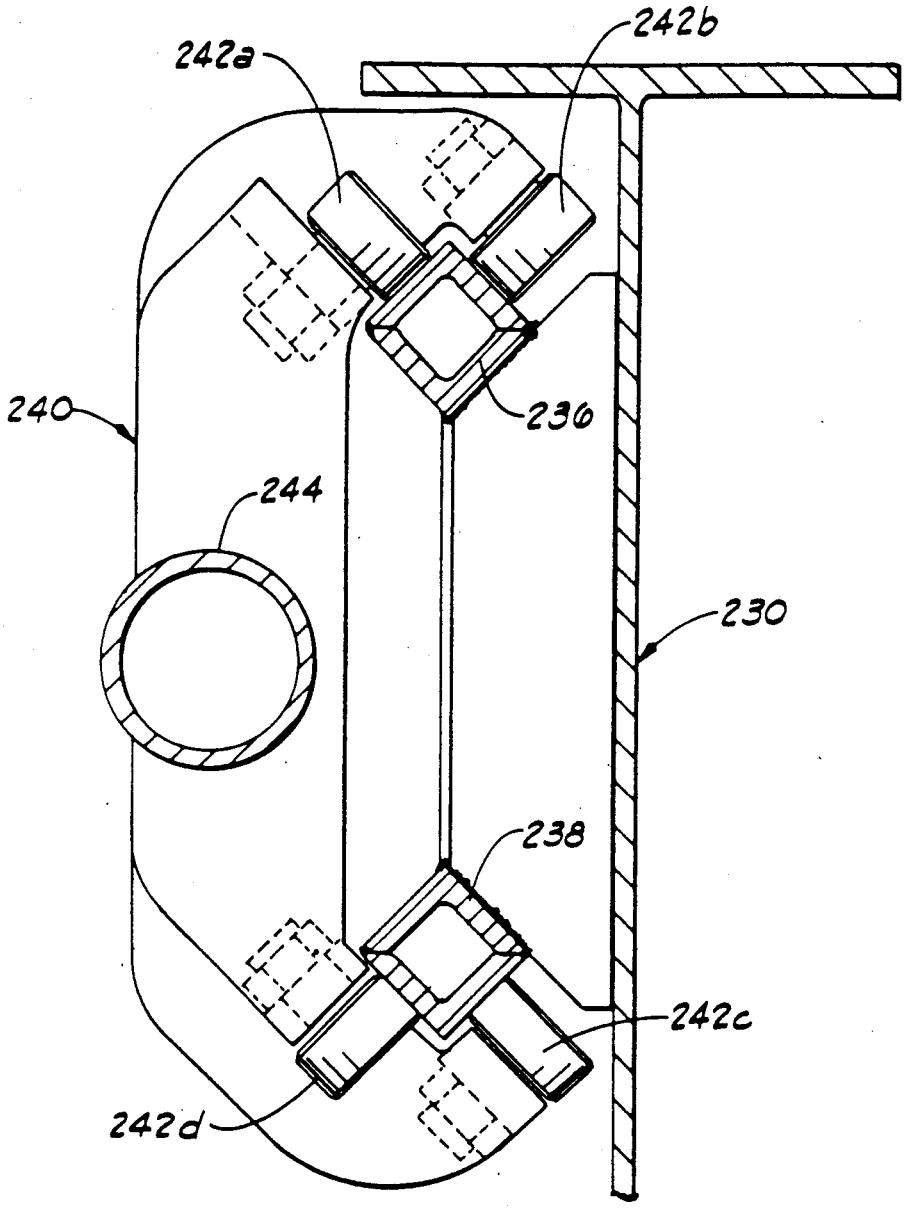
FIG. 26 is a partial sectional, partial elevational view showing the roller assembly for connecting the bridge to the jack-up rig.

As shown in FIG. 26, a pair of square pipes 236 and 238 are connected to the structure portion 230 and the pipes extend a distance generally along the structure portion 230 in the directions 226 and 228. A roller assembly 240 is connected to the lower surface 222 of the bridge 201. The roller assembly 240 includes a plurality of rollers 242 (four rollers being shown in FIG. 26 and designated therein by the reference numerals **242*a*, 242*b*, 242*c* and 242*d*). Two of the rollers 242*a* and 242*b* rollingly engage the pipe 236 and the other two rollers 242*c* and 242*d* rollingly engage the pipe 238. The bridge 201 thus is moveable in the lateral directions 226 and 228 via the rolling engage between the rollers 242 and the pipes 236 and 238**.

As shown in FIGS. 26 and 27, a pipe 244 extends outwardly from the roller assembly 240. The bridge 201 is pivotally connected to the pipe 242 via a bearing 246 thereby permitting the bridge 201 to be moved in the directions 232 and 234.

EMBODIMENTS OF FIGS. 28–32

Figure 28:
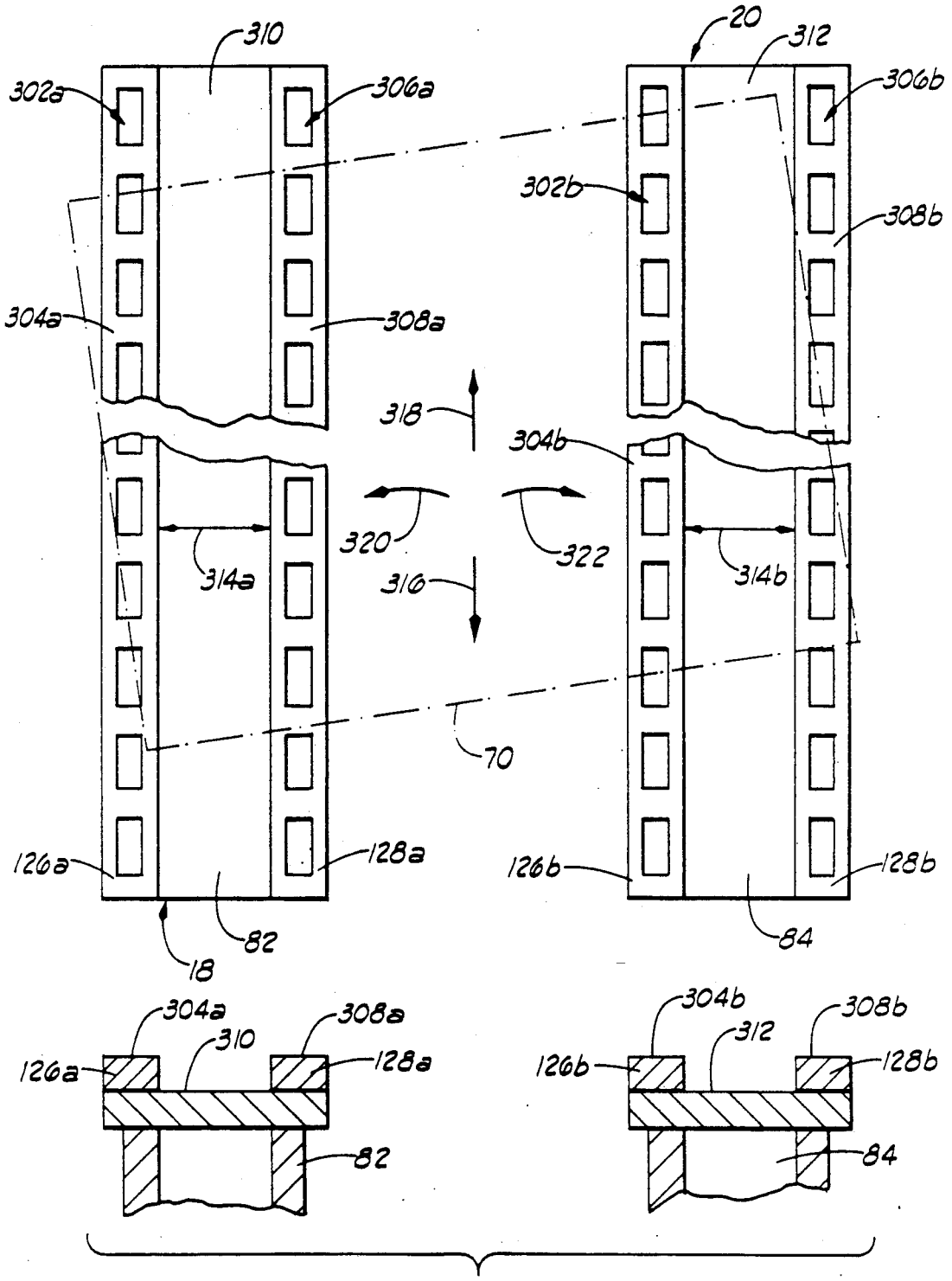
FIG. 28 is a top plan view of the I-beams on the fixed platform support structure showing in dashed lines the drilling module which has been positioned on the I-beams in a misaligned position and showing an end elevational view of the I-beams with the restraining bars connected thereto.
Figure 29:
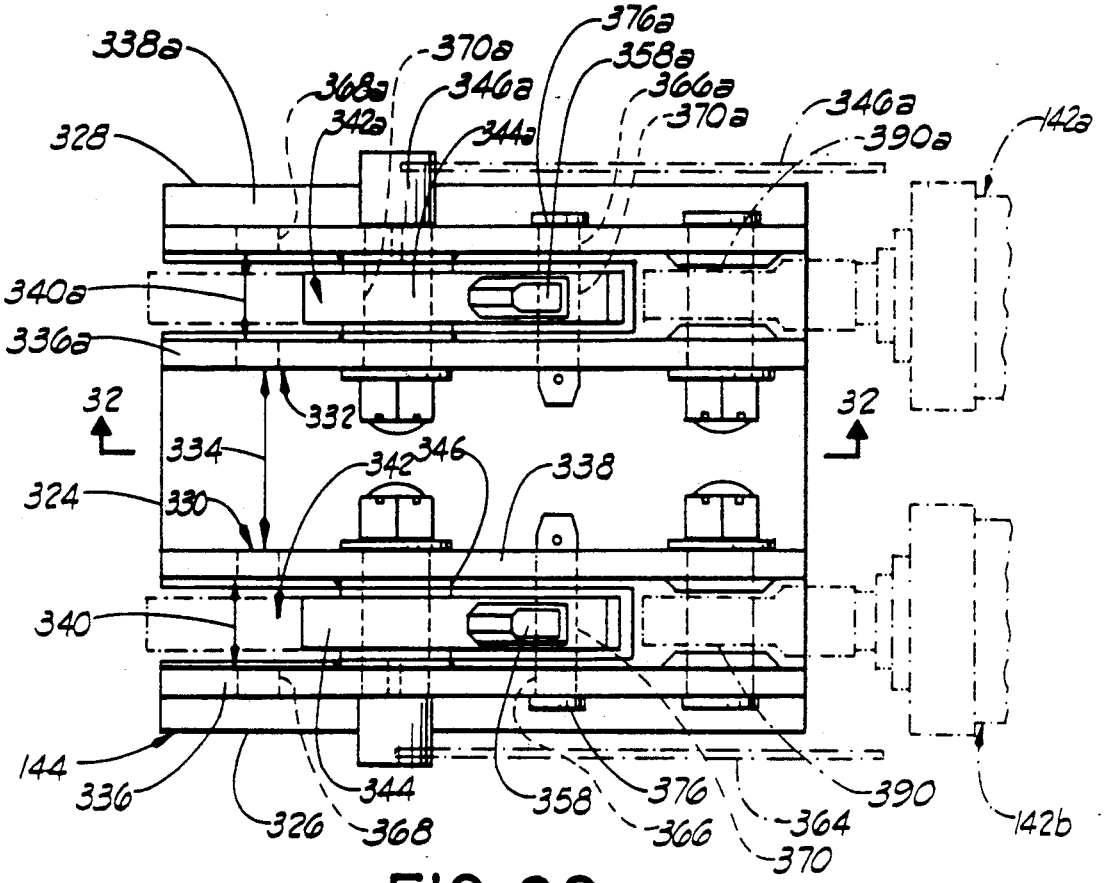
FIG. 29 is a top elevational view of a typical pad or guide shoe showing a portion of the positioning assembly for positioning the drilling module in an aligned position on the I-beams.

Shown in FIG. 29 is a more detailed view of the I-beams 82 and 84 with the restraining bars 126 and 128 being connected thereto. The restraining bars 126 and 128 connected to the 1-beam 82 more particularly are designated in FIG. 28 by the reference numerals **126*a* and 128*a*. The restraining bars 126 and 128 connected to the I-beam 84 more particularly are designated in FIG. 28 by the respective reference numerals 126*b* and 128*b***.

The restraining bars 126 each include a plurality of spaced apart claw recess 302 formed through an upper surface 304 thereof and spaced generally between the opposite ends of the restraining bar 126. The claw recesses in the restraining bar **126*a* more particularly are designated by the reference numeral 302*a* and the claw recesses in the restraining bar 126*b* more particularly are designated by the specific reference numeral 302*b*. Only one of the claw recesses 302*a* and only one of the claw recesses 302***b* are designated with specific reference numerals in FIG. 28. The respective upper surfaces of the restraining bars 126*a* and 126*b* are designated by the specific respective reference numerals 304*a* and 304*b*. The restraining bars 128 each include a plurality of spaced apart claw recesses 306 formed through an upper surface 308 thereof and spaced generally between the opposite ends of the restraining bars 128. The claw recesses in the restraining bar 128*a* more particularly are designated by the reference numeral 306*a* and the claw recesses in the restraining bar 128*b* more particularly are designated by the specific reference numerals 306*b*. Only one of the claw recesses 306*a* and only one of the claw recesses 306*b* are designated with specific reference numerals in FIG. 28. The respective upper surfaces of the restraining bars 128*a* and 128*b* are designated by the specific respective reference numerals 308*a* and 308*b*.

The beam 82 includes an upper surface 310 and the beam 84 includes an upper surface 312. The restraining bars 126 and 128 are connected to the upper surfaces 310 and 312 of the beams 82 and 84. The restraining bars 126 and 128 are spaced a distance 314 apart (the respective distances being shown in FIG. 28 and designated by the reference numerals 314*a* and 314*b*).

When the drilling module 32 is transferred to the fixed platform support structure 16, the guide shoes 114*a* and 114*c* ideally are aligned with the beam 82. A portion of each of the guide shoes 114*a* and 114*c* is disposed generally on the upper surfaces 304*a* and 308*a* of the respective restraining bars 126*a* and 128*a*, and a portion of each of the guide shoes 114*a* and 114*c* being disposed generally between the restraining bars 126*a* and 126*b*. Further, in an aligned position the guide shoes 114*b* and 114*d* are disposed on the upper surfaces 304*b* and 308*b* of the respective restraining bars 126*b* and 128*b*. A portion of the guide shoes 114*b* and 114*d* is disposed generally between the restraining bars 126*b* and 128*b*.

In transferring the drilling module 32 to the fixed platform support structure 16, it is common for the rig substructure 70 and the guide shoes 114 connected thereto initially to be misaligned with the beams 82 and 84. For example, the rig substructure 70 may set at an angle with respect to the beams 82 and 84, as diagrammatically illustrated in FIG. 28 by the dashed line representation of the drilling rig substructure 70. The misalignment is exaggerated as shown in FIG. 28 for illustration purposes. The present invention is adapted to correct this misalignment in a convenient and economical manner, as will be described in greater detail below.

The hydraulic cylinders 142 and the pads 144 are connected to the drilling module substructure 70 and the pads 144 are removably connectable to the upper surfaces 310 and 312 of the respective beams 82 and 84. More particularly, the pads 144 are removably connectable to the upper surfaces 304 and 308 of the restraining bars 126 and 128, in a manner and for reasons which will be made more apparent below.

The hydraulic cylinders 142 and the pads 144 combined with their interconnection with the drilling module substructure 70 comprise what sometimes is referred to herein as a positioning assembly with the restraining bars 126 and 128 cooperating to form a portion of such positioning assembly. The positioning assembly is adapted to move the drilling module substructure 70 on the upper surfaces 304 and 308 of the respective restraining bars 126 and 128 in a first direction 316 (FIG. 28) generally toward the front end 18 of the fixed platform support structure 16 or generally toward one end of the beams 82 and 84, and to move the drilling module substructure 70 in an opposite second direction 318 (FIG. 28) on the upper surfaces 304 and 308 of the respective restraining bars 126 and 128 generally toward the rear end 30 of the fixed platform module support structure 16 or generally toward the opposite end of the beams 82 and 84. The positioning assembly also is adapted and connected to the drilling module substructure 70 and removably connectable to the restraining bars 126 and 128 in such a manner that the positioning assembly can move the drilling module substructure 70 in a first pivotal direction 320 and in an opposite second pivotal direction 322. The positioning assembly thus is adapted to move the drilling module substructure 70 on the beams 82 and 84 in directions 316, 318, 320 and 322 for aligning the guide shoes 114*a* and 114*c* with the upper surface 310 of the beam 82 and the restraining bars 126*a* and 128*a* secured thereto and to align the guide shoes 114*b* and 114*d* with the upper surface 312 of the beam 84 and the restraining bars 126*b* and 128*b* connected thereto.

Figure 30:
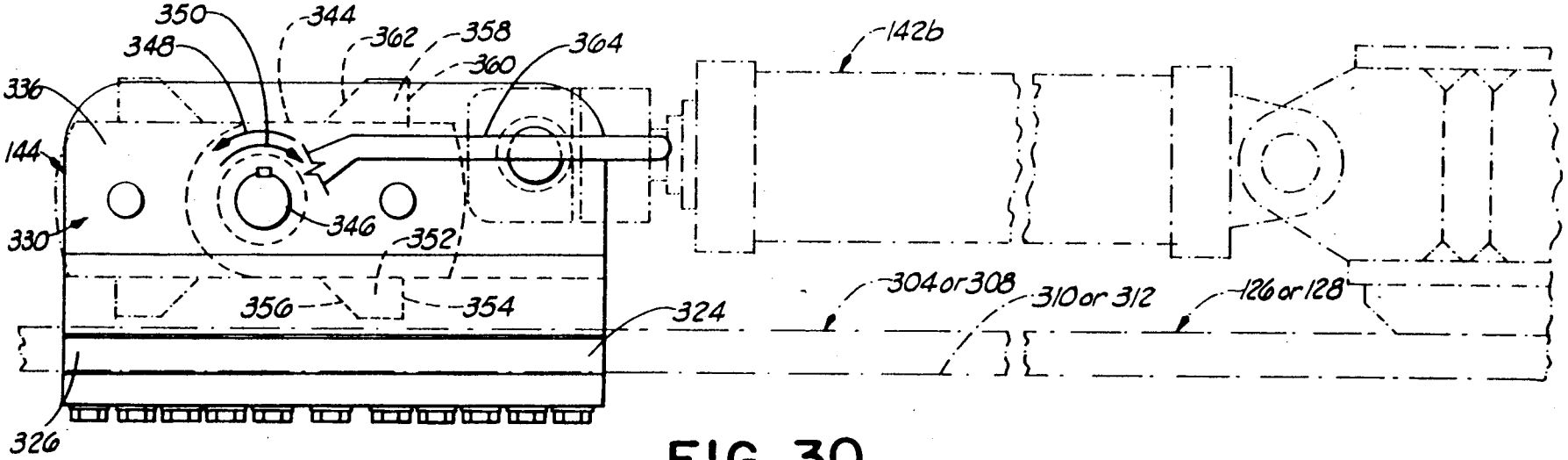
FIG. 30 is a side elevational view of the pad shown in FIG. 29.
Figure 31:
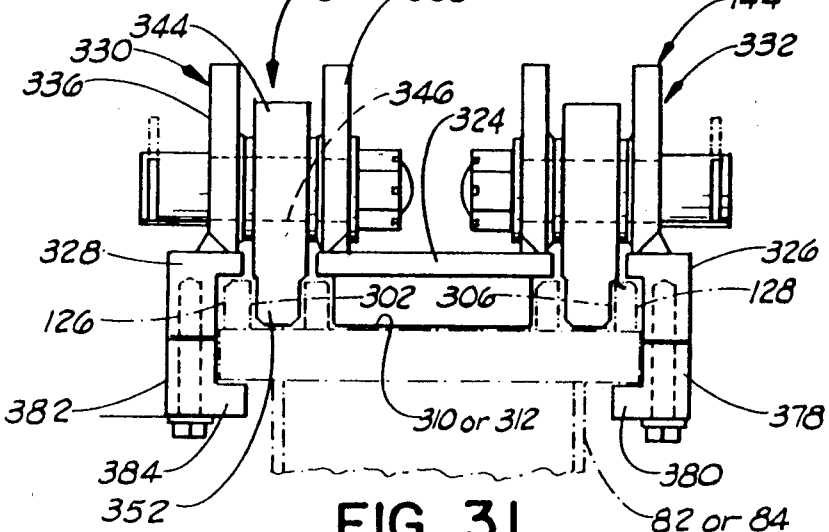
FIG. 31 is an end view of the pad shown in FIG. 29, looking into the left end of FIG. 29.

Shown in FIGS. 29, 30, 31 and 32 is a typical pad 144 which is connected to the hydraulic cylinders 142 and which forms a typical guide shoe 114, all of and which comprise a portion of the positioning assembly. The pad 144 comprises a pad base 324 having opposite sides 326 and 328. The pad base 324 is sized so that, when the pad 144 is positioned on the upper surface 310 or 312 of the beam 82 or 84, the side 326 of the pad base 314 extends a distance beyond one side of the beam 82 or 84 and the side 328 extends a distance generally beyond the opposite side of the beam 82 or 84, as shown in FIG. 31.

Each pad 144 also comprises a first claw support frame 330 and a second claw support frame 332. The first claw support frame 330 is disposed generally near the side 326 of the pad base 324 and the second claw support frame 332 is disposed generally near the side 328 of the pad base 324.

The claw support frames 330 and 332 are spaced apart a distance 334 (FIG. 29). The first claw support frame 330 and the second claw support frame 332 are substantially identical in construction and operation. The components of the second claw support frame 332 which are constructed and operate like corresponding components of the first claw support frame 330 are designated by reference numerals corresponding to the component reference numerals of the first claw support frame 330 except the various components of the second claw support frame 332 carry an additional designation of the letter "a" in FIGS. 29, 30, 31 and 32.

The claw support frames 330 and 332 each comprises a first claw frame member 336 or 336*a* and a second claw frame member 338 or 338*a*. Each of the claw frame members 336, 336*a*, 338 and 338*a* is connected to the pad base 324 and each claw frame member 336, 336*a*, 338 and 338*a* extends a distance generally upwardly from the pad base 324. The first claw frame member 336 or 336*a* is spaced a distance 340 or 340*a* (FIG. 29) from the second claw frame member 338 or 338*a*, respectively, forming respective claw spaces 342 and 342*a* (FIGS. 29 and 31) generally between the respective first claw frame member 336 or 336*a* and the second claw frame member 338 or 338*a*.

Claw support frames 344 and 344*a* are disposed generally within the respective claw spaces 342 and 342*a*. The claw support frames 344 and 344*a* are pivotally supported between the respective claw frame members 336 and 338 or 336a and 338a by respective pivot pins 346 and 346a. The claw support frames 344 and 344a are pivotally supported by the respective pivot pins 346 and 346a for pivotal movement between the claw frame members 336 and 338 and between the claw frame members 336a and 338a in one direction 348 (FIG. 30) and in an opposite direction 350 (FIG. 30).

Figure 32:
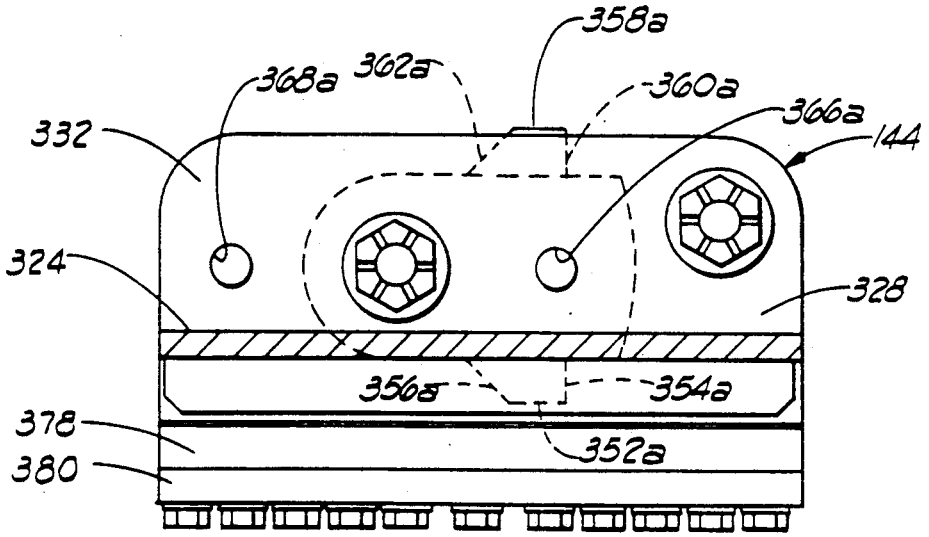
FIG. 32 is sectional view of the pad of FIG. 29 showing the second claw support frame and taken substantially along the lines 32—32 of FIG. 29.

A first claw 352 or 352a is connected to the respective claw support frames 344 or 344a. The first claws 352 and 352a each extend a distance from the respective claw support frame 344 or 344a and are shaped like a claw tooth having a flat edge 354 or 354a (FIGS. 30 and 32) and a beveled edge 356 or 356a (FIGS. 30 and 32).

A second claw 358 or 358a is connected to the respective claw support frames 344 or 344a. The second claws 358 and 358a each extend a distance from the respective claw support frames 344 or 344a and are connected to a side of the respective claw support frames 344 or 344a generally opposite the side connected to the respective first claw 352 or 352a. The second claws 358 and 358a are each constructed exactly like the first claws 352 and 352a are shaped somewhat like a claw tooth having respective flat edges 360 or 360a and respective beveled edges 362 or 362a.

The first claws 352 and 352a each sized to be removably disposed in one of the claw recesses 302 formed in the upper surface 304 of the restraining bar 126 during the operation of the positioning assembly. The second claws 358 and 358a each are sized to be removably disposed within one of the claw recesses 306 formed in the upper surface 310 of the restraining bar 128.

One end of a handle 364 or 364a is connected to the respective pivot pin 346 or 346a and each of the handles 364 and 364a extends a distance from the respective pivot pins 346 and 346a.

First stop openings 366 are formed through the first and the second claw frame members 336 and 338. Second stop openings 368 are formed through the first and the second claw frame members 336 and 338. The second stop openings 366 are generally aligned with and spaced a distance from the second stop openings 368.

In a like manner, first stop openings 366a are formed through the first and the second claw members 336a and 338a. Second stop openings 368a are formed through the first and the second claw frame members 336a and 338a with the first and the second stop openings 336a and 368a being generally aligned and spaced a distance from each other.

A frame stop opening 370 (FIG. 29) is formed through the claw support frame 344. In one position of the claw support frame 344, the frame stop opening 370 is aligned with the first stop openings 366 and a stop pin 376 is disposed through the first stop openings 366 and through the frame stop opening 370 for securing the claw support frame 344 in one position disposed within the claw space 342.

In one other position of the claw support frame 344, the frame stop opening 370 is aligned with the second stop opening 368 and, in this position of the claw support frame 344, the stop pin 376 is disposable through the second stop openings 368 and through the frame stop opening 370 to secure the claw support frame 344 in this position within the claw space 342.

A frame stop opening 378 is formed through the claw support frame 344a. In one position of the claw support frame 344a, the frame stop opening 370a is aligned with the first stop openings 366a and a stop pin 376a is disposed through the first stop openings 366a and through the frame stop opening 370a for securing the claw support frame 344a in one position disposed within the claw space 342a.

In one other position of the claw support frame 344a, the frame stop opening 370a is aligned with a second stop opening 368a and, in this position of the claw support frame 344a, the stop pin 376a is disposable through the second stop openings 368a and through the frame stop opening 370a to secure the claw support frame 344a in this position within the claw space 342a.

When drilling module substructure 70 is positioned on the upper surfaces 304 and 308 of the restraining bars 126 and 128 as shown in FIG. 32, a first clamp member 378 (FIG. 31) is connected to the side 326 of the pad base 324. The clamp member 378 extends a distance from the pad base 324 and includes a portion 380 which extends under an upper portion of the beam 82 or 84 for cooperating to securing the pad 144 to the beam 82 or 84.

A second clamp member 382 (FIG. 31) is connected to the side 328 of the pad base 324. The second clamp member 382 extends a distance generally downwardly from the side 328 of the pad base 324. The second clamp member 382 includes a portion 384 which extends generally under a portion of the beam 82 or 84. The second clamp member 82 cooperates to secure the pad 144 to the beam 82 or 84.

Assuming the rig substructure 70 initially has been positioned on the I-beams 82 and 84 in the position shown in dashed lines in FIG. 28 for example, the pad 114c is positioned so that the flat edges 354 and 354a of the respective first claws 352 and 352a each are disposed in one of the respective claw recesses 302a and 306a of the restraining bars 126a and 128a (handles 364 and 364a each being moved to a position wherein the frame stop openings 370 and 370a are aligned with the respective first openings 366 and 366a). Further, the pads 144 on the guide shoes 114b and 114d are positioned so that the flat edges 360 and 360a of the respective second claws 358 and 358a each engage the forward portions of the claw recesses 302b and 306b in the restraining bars 126b and 128b, respectively, (the handles 364 and 364a each being positioned so that the respective frame stop openings 370 and 370a each are aligned with the respective second stop openings 368 and 368a in this position).

In this position of the pads 144, when the hydraulic cylinders 142a and 142b associated with the pads 146a and 114c each are actuated to retract the cylinder rod, the first claws 352 and 352a engage the respective rearward edges of the claw recesses 302a and 306a thereby moving the left edge of the rig substructure 70 in the direction 318 thereby tending to pivot the rig substructure 70 in the direction 322 and tending to bring the rig substructure 70 into alignment with the I-beams 82 and 84. By the same token, when the hydraulic cylinders 142a and 142b associated with the pads 114b and 114d each are actuated, the flat edges 360 and 360a of the second claws 358 each engage the forward edges of the claw recesses 302b and 306b tending to move the right edge of the rig substructure 70 in the direction 316 intending to pivot the rig substructure in the direction 322.

Depending on the length of the cylinder rods, the rig substructure 70 will be moved in the manner just described a small distance and then it will be necessary to reset the pads 144. To reset the pads 144, the hydraulic cylinders 142a and 142b associated with the pads 114a and 114c are actuated thereby moving the respective cylinder rods out therefrom. As the cylinder rods are moved out of the respective hydraulic cylinders 142a and 142b associated with the pads 144a and 144c, the beveled edges 356 and 356a of the respective claws 352 and 352a each engage the forward portions of the claw recesses 302a and 306a thereby permitting the first claws 352 and 352a to be removed from the claw recesses 302a and 306a and moved in the forward direction 318 until the first claws 352 and 352a again are disposed in other ones of the claw recesses 302a and 306a so that the process may be repeated.

By the same token, the hydraulic cylinders 142a and 142b associated with the pads 144b and 144d are actuated to move the cylinder rods outwardly from the cylinders thereby moving the second claws 358 and 358a in a general direction 316. As the second claws 358 and 358a are moved in the second direction 316, the beveled edges 362 and 362a engage the forward edges of the claws recesses 302b and 306b thereby permitting the second claws 358 and 358a to be moved in the direction 316 until the second claws 358 and 358a have been positioned in other claw recess 302b and 306b so that the process again may be repeated.

It should be noted that, during the alignment process, it may only be necessary to actuate the hydraulic cylinders 142a and 142b associated with either the pads 144a and 144c or with the pads 114b and 114d. In any event, the hydraulic cylinders 142a and 142b are actuated and the claws 352, 352a and/or 358 and 358a engage the respective restraining bars 126a, 126b, 128a and 128b for moving the rig substructure 70 until the rig substructure 70 has been brought into alignment with the I-beams 82 and 84.

The hydraulic cylinder 142a and 142b each are connected to the pad 144 via respective spherical bearings 390 and 390a to permit movement between the hydraulic cylinders 142a and 142b in generally upwardly and downwardly directions and in directions generally toward the right and generally toward the left to facilitate the movement between the hydraulic cylinders 142a and 142b and the pads 144 during the alignment process described above.

When the rig substructure 70 is brought into alignment with the I-beams 82 and 84, the first and the second clamps 378 and 382 are clamped to the respective I-beams 82 and 84 to secure the rig substructure in a connected position to the I-beams 82 and 84.

When initially aligning the cantilever beam assembly 42 with the beam opening 28 on the fixed platform support structure 16, it is common for the rig substructure 70 of the drilling module 32 to be misaligned with the beam opening 28 in the sense that the left side of the rig substructure 70 may be higher than the right side of the rig substructure 70 or the forward end of the rig substructure may be higher than the rearward end of the rig substructure 70 or the rearward end of the rig substructure 70 may be higher than the forward end of the rig substructure. As mentioned before, the hull 46 is movably supported on the legs 12a, 12b and 12c so that the hull 46 can be moved on the legs 36 in the generally upwardly direction 38 or the generally downwardly direction 40.

If the hull 46 or, more particularly, the cantilever beam assembly 42 initially is misaligned with the beam opening 28 in the sense that the right side of the cantilever beam assembly 42 is higher than the left side of the cantilever beam assembly 42, the hull 46 is moved in the downwardly direction 40 on the leg 36b to a position wherein the cantilever beam assembly 42 is aligned with the angular position or disposition of the beam opening 28. By the same token and assuming the left side of the cantilever beam assembly 42 is higher than the right side of the cantilever beam assembly 42, the hull 46 is moved downwardly on the leg 36a to a position wherein the cantilever beam assembly 42 is aligned with the angular position or disposition of the beam opening 28.

In a like manner, assuming the rearward end 48 of the cantilever beam assembly 42 is lower than the forward end 50 of the cantilever beam assembly 42, the hull may be raised on the legs 36a and 36b to align the cantilever beam assembly with the beam opening 28. By the same token, assuming the forward end 50 of the cantilever beam assembly 42 is lower than the rearward end 48 of the cantilever beam assembly 42, the forward end of the hull 46 may be raised on the leg 36c to a position wherein the cantilever beam assembly 42 is generally aligned with the beam opening 28.

Changes may be made in the construction and the operation of the various parts, elements and assemblies described herein and changes may be made in the steps or the sequence of steps of the methods described herein without departing from the spirit and scope of the invention as defined in the following claims.

What is claimed is:

1. A method for transferring a drilling module from a jack-up rig t a fixed platform wherein the fixed platform comprises a fixed platform support structure connected to legs which are secured to an ocean floor and wherein the fixed platform support structure has a drilling module support surface disposed thereon and wherein the jack-up rig comprises telescoping legs and wherein a portion of the jack-up rig is movable and upwardly and downwardly directions on each of the leg and wherein a cantilever beam assembly is supported on the jack-up rig and wherein having a forward end and a rearward end means for moving the cantilever beam assembly from a storage position wherein the cantilever beam assembly is supported generally on the jack-up rig to extended positions wherein the rearward end portion of the cantilever beam assembly is extended distances generally from the jack-up rig is supported on the jack-up rig, the method comprising:

supporting the drilling module on the cantilever beam assembly;

positioning the jack-up rig near the fixed platform;

aligning the drilling module with the drilling module support surface by moving the jack-up rig upwardly or downwardly on at least one of the legs supporting the jack-up rig until the drilling module generally is aligned with an angular disposition of the drilling module support surface on the fixed platform support structure; and moving the cantilever beam assembly with the drilling module supported thereon to an extended position wherein the drilling module is supported generally over the drilling module support surface;

removing the drilling module form the cantilever beam assembly and supporting the drilling module on the drilling module support surface on the fixed platform;

wherein the drilling module includes a lower substructure support surface and wherein the cantilever beam assembly includes a beam support surface and wherein a portion of the drilling module is supported on the beam support surface and wherein the method further comprises:

connecting a fixed platform support structure to the fixed platform wherein the drilling module support surface is disposed on the fixed platform support structure and wherein the fixed platform support structure has a front end, an rear end and beam opening extending through the front end of the fixed platform support structure and extending a distance generally toward the rear end of the fixed platform support structure; and wherein the step of aligning the drilling module is further defined as aligning the drilling module with the beam opening in the fixed platform support structure and with the lower substructure support surface of the drilling module being disposed in an angular plane spaced a distance generally above an angular plane in which the drilling module support surface of the fixed platform support structure is disposed; and wherein the step of moving the cantilever beam assembly to the extended position is further defined as moving the cantilever beam assembly with the drilling module supported thereon from the jack-up rig and through at least a portion of the beam opening in the fixed platform support structure to a position wherein the lower substructure support surface of the drilling module is disposed a distance generally above the drilling module support surface of the fixed platform support structure; and wherein the step of removing the drilling module from the cantilever beam assembly further comprises:

lowering a portion of the jack-up rig in a generally downwardly direction to lower the cantilever beam assembly to a position wherein the lower substructure support surface of the drilling module is disposed generally on the drilling module support surface of ht fixed platform support structure and further lowering the jack-up rig to lower the cantilever beam assembly to a position wherein the beam support surface is spaced a distance generally below the lower substructure support surface of the drilling module thereby disconnecting the cantilever beam assembly from the drilling module.

2. An apparatus for positioning a drilling module having opposite sides, comprising:

a first beam having an upper surface;

a second beam having an upper surface, the first beam being spaced a distance from the second beam;

restraining bar means connected to the first beam and having a plurality of spaced apart claw recesses formed therein;

restraining bar means connected to the upper surface of the second beam having a plurality of claw recesses formed therein, the restraining bar means on the first and the second beams cooperating to form a drilling module support surface;

two guide shoes with one guide shoe assembly being connected to one side of the drilling module and the other guide shoe assembly being connected to the opposite side of the drilling module, each guide shoe assembly comprising:

a pad base;

a claw support frame means connected to the pad base;

a claw support member movably connected to the claw support frame for movement in one direction to one position and for movement in another direction to another position;

a first claw connected to the claw support member and second claw connected to the claw support member, the first claw of the guide shoe connected to the one side of the drilling module being engagable with the claw recesses in the restraining bar means connected to the first beam in one position of the claw support member and the second claw of the guide shoe connected to the one side of the drilling module being engagable with the claw recesses in the restraining bar means connected to the first beam in the other position of the claw support member, and the first claw of the guide shoe connected to the opposite side of the drilling module being engagable with a claw recesses in the restraining bar means connected to the second beam in the one position of the claw support member and the second claw of the guide shoe connected to the opposite side of the drilling module being engagable with the claw recesses in the restraining bar means connected to the upper surface of the second beam in the one other position of the claw support member;

means for moving the pad bases of each of the guide shoes in a forward direction in one position of the claw support members whereby the first claw of the guide shoe connected to the one side of the drilling module engages the claw recesses in the restraining bar means connected to the first beam and the first claw of the guide shoe connected to the opposite side of the drilling module engages the claw recesses in the restraining bar means connected to the upper surface of the second beam for moving the drilling module in a generally forward direction, and for moving the pad bases of the guide shoes in a rearward direction in the one other position of the claw support member whereby the second claw of the guide shoe connected to the one side of the drilling module engages the claw recesses in the restraining bar means connected to the upper surface of the first beam and the second claw of the pad connected to the opposite side of the drilling module engages the claw recesses in the restraining bar means connected to the upper surface of the second beam for moving the pad bases and the drilling module connected thereto in a rearward direction, and for moving the pad base connected to the one side of the drilling module in a forward direction in the one position of the claw support member whereby the first claw of the guide shoe connected to the one side of the drilling module engages the claw recesses in the restraining bar means connected to the upper surface of the first beam for moving the drilling module in a first pivotal direction, and for moving the pad base of the guide shoe connected to the opposite side of the drilling module in a forward direction in one position of the claw support member whereby the first claw of the guide shoe connected to the opposite side of the drilling module engages the claw recesses in the restraining bar means connected to the upper surface of the second beam for moving the drilling module in an opposite second pivotal direction.

3. The apparatus of claim 2 wherein each claw support frame means further comprises:

a first claw frame support member connected to the pad base and extending a distance therefrom; a second claw frame support member connected to the pad base and extending a distance therefrom, the second claw frame support member being spaced a distance from the first claw frame support member forming a claw space therebetween;

a claw support member being disposed generally in the claw space between the first and the second claw frames support member;

means for pivotally connecting the claw support member to the first and the second claw frame support members;

means for securing the claw support member in the one position and means for securing the claw support member in the other positions.

4. An apparatus for transferring a drilling module having a lower substructure support surface from a jack-up rig to a fixed platform wherein the fixed platform comprises legs secured to an ocean floor and wherein the jack-up rig comprises telescoping legs and wherein a portion of the jack-up rig is movable in generally upwardly and downwardly directions on the legs and wherein a cantilever beam assembly, having a forward end, a rearward end and a beam support surface, is supported on the jack-rig and wherein means for moving the cantilever beam assembly, from a storage position wherein the cantilever beam assembly is supported generally on the jack-up rig to extend positions wherein the rearward end of the cantilever beam assembly is extended distances generally from the jack-up rig, is supported on the jack-up rig, the apparatus comprising:

a fixed platform support structure connected to the fixed platform having a drilling module support surface thereon;

means for supporting the drilling module on the beam support surface of the cantilever beam assembly whereby the cantilever beam assembly is extendible to an extended position for disposing the drilling module on the drilling module support surface on the fixed platform support structure;

means connected to the drilling module having a portion removably engageable with the drilling module support surface or moving the drilling module on the drilling module support surface in at least one of a forward direction, a rearward direction, a first pivotal direction and a generally opposite second pivotal direction to move the drilling module to a predetermined aligned position on the drilling module support surface; comprising:

at least one guide shoe, each guide shoe being connected to the drilling module and each guide shoe comprising:

a pad base;

claw support frame means connected to the pad base;

a claw support member connected tot he claw support frame means;

claw means connected to the claw support member, said claw means being engageable with a portion of the drilling module support surface; and means for moving the pad base whereby the claw means engages a portion of the drilling module support surface as the pad base is moved for moving the pad base and the drilling module connected thereto on the drilling module support surface.

5. An apparatus for transferring a drilling module having a lower substructure support surface from a jack-up rig to a fixed platform wherein the fixed platform comprises legs secured to an ocean floor and wherein the jack-up rig comprises telescoping legs and wherein a portion of the jack-up rig is movable in generally upwardly and downwardly directions on the legs and wherein a cantilever beam assembly, having a forward and, a rearward end and a beam support surface, si supported on the jack-rig and wherein means for moving the cantilever beam assembly, from a storage position wherein the cantilever beam assembly is supported generally on the jack-up rig to extended positions wherein the rearward end of the cantilever beam assembly is extended distances generally from the jack-up rig, is supported on the jack-up rig, the apparatus comprising:

a fixed platform support structure connected to the fixed platform having a drilling module support surface thereon;

means for supporting the drilling module on the beam support surface of the cantilever beam assembly whereby the cantilever beam assembly is extendible to an extended position for disposing the drilling module on the drilling module support surface on the fixed platform support structure;

means connected to the drilling module having portion removably engageable with the drilling module support surface for moving the drilling module on the drilling module support surface in at least one of a forward direction, a rearward direction, a first pivotal direction and a generally opposite second pivotal direction to move the drilling module to a predetermined aligned position on the drilling module support surface; comprising:

at least one guide shoe, each guide shoe being connected to the drilling module and each guide shoe comprising:

a pad base;

claw support frame means connected to the pad base;

a claw support member pivotally connected to the claw support frame means for pivotal movement in one direction and for pivotal movement in an opposite direction;

a first claw connected to the claw support member and being engageable with a portion of the drilling module support surface in one position of the claw support member;

a second claw connected to the claw support member and being engageable with the portion of the drilling module support surface in one other position of the claw support member; and means for moving the pad base in one position of the claw support member whereby the first claw engages a portion of the drilling module support surface as the pad base is moved for moving the pad base and the drilling module connected thereto in the forward direction an for moving the pad base in one other position of the claw support member whereby the second claw engages a portion of the drilling module support surface as the pad base is moved for moving the pad base and the drilling module connected thereto on the drilling module support surface in a rearward direction.

6. An apparatus for transferring a drilling module having opposite sides and a lower substructure support surface from a jack-up rig to a fixed platform wherein the fixed platform comprises legs secured to an ocean floor and wherein the jack-up rig comprises telescoping legs and wherein a portion of the jack-up rig is movable in generally upwardly and downwardly directions on the legs and wherein a cantilever beam assembly, having a forward end, a rearward end an a beam support surface, is supported on the jack-rig and wherein means for moving the cantilever beam assembly, from a storage position wherein the cantilever beam assembly is supported generally on the jack-up rig to extended positions wherein the rearward end of the cantilever beam assembly is extended distances generally from the jack-up rig, is supported on the jack-up rig, the apparatus comprising:

a fixed platform support structure connected to the fixed platform having a drilling module support surface thereon;

means for supporting the drilling module on the beam support surface of the cantilever beam assembly whereby the cantilever beam assembly is extendible to an extended position for disposing the drilling module on the drilling module support surface on the fixed platform support structure;

means connected to the drilling module having portion removably engageable with the drilling module support surface for moving the drilling module on the drilling module support surface in at least one of a forward direction, a rearward direction, a first pivotal direction and a generally opposite second pivotal direction to move the drilling module to a predetermined aligned position on the drilling module support surface; comprising:

at least one guide shoe connected to the drilling module and dispose generally near one side of the drilling module and at least one other guide shoe connected to the drilling module generally near the opposite side of the drilling module, each guide shoe comprising:

a pad base;

a claw support frame means connected to the pad base;

a claw support member pivotally connected to the claw support frame means for movement in one pivotal direction an for movement in an opposite pivotal direction;

a first claw connected to the claw support member and being engageable with a portion of the drilling module support surface in one position of the claw support member;

a second claw support connected to the claw support member and being engageable with a portion of the drilling module support surface in one other position of the claw support member; and means for moving the pad base whereby, when the pad bases on both sides of the drilling module are moved in a forward direction in one position of the claw support member, the first claws of the guide shoes engage portions of the drilling module support surface for moving the pad base and the drilling module connected thereto in a forward direction on the drilling module support surface, and whereby, when the pad base of the guide shoes on both sides of the drilling module are moved in the rearward direction in one position of the claw support member, the second claws of the guide shoes each engage a portion of the drilling module support surface for moving the pad bases and the drilling module connected thereto on the drilling module support surface in a rearward direction, and whereby, when the pad base of the guide shoe on one side of the drilling module is moved in a forward direction in one position of the claw support member, the first claws of the guide shoe on the one side of the drilling module engage a portion of the drilling module support surface of moving the pad base and the drilling module connected thereto on the drilling module support surface in a first pivotal direction and whereby, when the pad base on the opposite side of the drilling module is moved in a forward direction in one position of the claw support member, the first claws on each guide shoe on the opposite side of the drilling module engage portions of the drilling module support surface for moving the pad base and the drilling module connected thereto on the drilling module support surface int he second pivotal direction.

7. An apparatus for transferring a drilling module having opposite sides and a lower substructure support surface from a jack-up rig to a fixed platform wherein the fixed platform comprises legs secured to an ocean floor an wherein the jack-up rig comprises telescoping legs and wherein a portion of the jack-up rig is movable in generally upwardly and downwardly directions on the legs and wherein a cantilever beam assembly, having a forward end, a rearward end and a beam support surface, is supported on the jack-rig and wherein means for moving the cantilever beam assembly, from a storage position wherein the cantilever beam assembly is supported generally on the jack-up rig to extended positions wherein the rearward end of the cantilever beam assembly is extended distances generally form the jack-up rig, is supported on the jack-up rig, the apparatus comprising:

a fixed platform support structure connected to the fixed platform having a drilling module support surface thereon;

means for supporting the drilling module on the beam support surface of the cantilever beam assembly whereby the cantilever beam assembly is extendible to an extended position for disposing the drilling module on the drilling module support surface on the fixed platform support structure;

means connected to the drilling module having portion removably engageable with the drilling module support surface for moving the drilling module on the drilling module support surface on the fixed platform support structure;

means connected to the drilling module having portion removably engageable with the drilling module support surface for moving the drilling module on the drilling module support surface in at least one of a forward direction, a rearward direction, a first pivotal direction and a generally opposite second pivotal direction to move the drilling module to a predetermined aligned position on the drilling module support surface; comprising:

two guide shoes, one guide shoe being connected to one side of the drilling module and the other guide shoe being connected to the opposite side of the drilling module, each guide shoe comprising:

a pad base;

a first claw support frame connected to the pad base and extending a distance therefrom;

a second claw frame support member connected to the pad base and extending a distance therefrom, the second claw frame support member being spaced a distance from the first claw frame support member forming a claw space therebetween;

a claw support member disposed generally in the claw space and being pivotally connected to the first and the second claw frame support member for pivotal movement in one direction an for pivot movement in an opposite direction;

a first claw connected to the claw support member and a second claw connected to the claw support member, the claw support member being movable to one position wherein the first claw engages the drilling module support surface and the claw support member being movable to one other position whereby the second claw engages a portion of the drilling module support surface and means for moving the guide shoes on each of the sides of the drilling module in one direction and in one position of the claw support member whereby the first claws on each of the guide shoes engage the drilling module support surface for moving the drilling module in a forward direction on the drilling module support surface as the guide shoes are moved in the forward direction, and for moving each of the pad bases of the guide shoes on both sides of the drilling module in a rearward direction whereby the second claws of each of the guide shoes engages a portion of the drilling module support surface for moving the pad base and the drilling module connected thereto on the drilling module support surface in the rearward direction, and for moving the pad base of the guide shoe on one side of the drilling module in a forward direction whereby the first claws of the guide shoe on the one side of the drilling module engage a portion of the drilling module support surface for moving the pad base and the drilling module connected thereto on the drilling module support surface in one pivotal direction, and for moving the pad base of the guide shoe on the opposite side of the drilling module in a forward direction whereby the first claws of the guide shoes on the opposite side of the drilling module engage a portion of the drilling module support surface for moving the pad base and the drilling module connected thereto on the drilling module support surface in a second pivotal direction.

8. The apparatus of claim 7 further comprising:

means for removably securing the pad base to the drilling module support surface.

9. The apparatus of claim 7 further comprising:

means for securing the claw support member in the one position wherein the first claw removably engages a portion of the drilling module support surface and means for securing the claw support member in the other position wherein the second claw removably engages a portion of the drilling module support surface.

10. The apparatus of claim 7 wherein the drilling module support surface comprises a pair of beam means with each beam means having an upper surface;

restraining bar means secured to the upper surface of each of the beam means, a plurality of claw recesses being formed in the upper surface of each of the restraining bar means with each recess being sized and shaped for receiving one of the first claw or the second claw.

11. An apparatus for transferring a drilling module having opposite sides and a lower substructure support surface from a jack-up rig to a fixed platform wherein the fixed platform comprises legs secured to an ocean floor and wherein the jack-up rig comprises telescoping legs and wherein a portion of the jack-up rig is movable in generally upwardly and downwardly directions on the legs and wherein a cantilever beam assembly, having a forward end, a rearward end and a beam support surface, is supported on the jack-rig and wherein means for moving the cantilever beam assembly, from a storage position wherein the cantilever beam assembly is supported generally on the jack-up rig to extended positions wherein the rearward end of the cantilever beam assembly is extended distances generally from the jack-up rig, is supported on the jack-up rig, the apparatus comprising:

a fixed platform support structure connected to the fixed platform having a drilling module support surface thereon, comprising;

a first beam connected t the fixed platform support structure and having an upper surface; and a second beam connected to the fixed platform support structure and having an upper surface, the second beam being spaced a distance from the first beam;

restraining bar means connected to the first beam having a plurality of spaced apart claw recesses formed therein; and restraining bar means connected to the upper surface of the second beam having a plurality of claw recesses formed therein the restraining bar means on the first and second means cooperating to form the drilling module support surface; and means for supporting the drilling module on the beam support surface of the cantilever beam assembly whereby the cantilever beam assembly is extendible to an extended position for disposing the drilling module on the drilling module support surface on the fixed platform support structure;

means connected to the drilling module having portion removably engageable with the drilling module support surface for moving the drilling module on the drilling module support surface in at least one of a forward direction, a rearward direction, a first pivotal direction and a generally opposite second pivotal direction to move the drilling module to a predetermined aligned position on the drilling module support surface; comprising:

two guide shoes with one guide shoe being connected to one side of the drilling module and one other guide shoe being connected to the opposite side of the drilling module, each guide shoe comprising:

a pad base;

claw support frame means connected to the pad base;

a claw support member movably connected to the claw support frame;

means for moving the claw support member to one position and to one other position;

a first claw connected tothe claw support member with the first claw of the guide connected to one side of the drilling module being engageable with the claw recesses int he restraining bar means connected to the first beam and the first claw of the guide connected to the opposite side of the drilling module being engageable with the claw recesses in the restraining bar means connected to the second beam;

means for moving the guide shoe base connected to the one side of the drilling module in a forward direction whereby the first claw of the guide shoe connected to the one side of the drilling module engages the claw recesses in the restraining bar means connected to the first beam and the first claw of the guide shoe connected to the opposite side of the drilling module engages the claw recesses in the restraining bar means connected to the upper surface of the second beam for moving the pad base and the drilling module connected thereto on the drilling module support surface in a forward direction, and for moving the guide shoe base connected to the opposite sides of the drilling module in a rearward direction whereby the second claw of the guide shoe connected to the one side of the drilling module engages the claw recesses in the restricting bar means connected to the first beam and the second claw of the guide shoe connected to the opposite side of the drilling module engages the claw recesses in the restraining bar means connected to the second beam for moving the pad bases and the drilling module connected thereto on the drilling module support surface in a rearward direction, and for moving the pad base connected to the one side of the drilling module in a forward direction whereby the first claw of the guide shoe connected to the one side of the drilling module engages the claw recesses int eh restraining bar means connected to the first beam for pivotally moving the drilling module on the drilling module support surface in a first pivotal direction, and for moving the pad base connected to the opposite side of the drilling module in a forward direction whereby the first claw of the guide shoe connected to the opposite side of the drilling module engages the claw recesses in the restraining bar means connected to the second beam for moving the pad base and the drilling module connected thereto on the drilling module support surface in a second pivotal direction.

* * * * *